US010211543B2

(12) United States Patent
Oppenlaender et al.

(10) Patent No.: US 10,211,543 B2
(45) Date of Patent: Feb. 19, 2019

(54) ANTENNA SYSTEM FOR BROADBAND SATELLITE COMMUNICATION IN THE GHZ FREQUENCY RANGE, COMPRISING DIELECTRICALLY FILLED HORN ANTENNAS

(71) Applicant: Lisa Dräxlmaier GmbH, Vilsbiburg (DE)

(72) Inventors: Joerg Oppenlaender, Kirchentellinsfurt (DE); Michael Wenzel, Lueneburg (DE); Alexander Moessinger, Tuebingen (DE); Michael Seifried, Altdorf (DE); Christoph Haeussler, Reutlingen (DE); Alexander Friesch, Tuebingen (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 385 days.

(21) Appl. No.: 14/412,560

(22) PCT Filed: Jul. 2, 2013

(86) PCT No.: PCT/EP2013/001925
§ 371 (c)(1),
(2) Date: Jan. 2, 2015

(87) PCT Pub. No.: WO2014/005693
PCT Pub. Date: Jan. 9, 2014

(65) Prior Publication Data
US 2015/0162668 A1 Jun. 11, 2015

(30) Foreign Application Priority Data
Jul. 3, 2012 (DE) ..... 10 2012 013 130

(51) Int. Cl.
*H01Q 13/00* (2006.01)
*H01Q 21/06* (2006.01)
(Continued)

(52) U.S. Cl.
CPC ..... *H01Q 21/064* (2013.01); *H01Q 13/02* (2013.01); *H01Q 13/025* (2013.01); *H01Q 15/08* (2013.01);
(Continued)

(58) Field of Classification Search
CPC .... H01Q 13/02; H01Q 21/0075; H01Q 21/00; H01Q 15/08; H01Q 15/24; H01Q 19/08
See application file for complete search history.

(56) References Cited

U.S. PATENT DOCUMENTS 4,274,097 A * 6/1981 Krall ..... H01Q 13/24 343/719
4,783,663 A * 11/1988 Rammos ..... H01Q 21/064 343/778
(Continued)

FOREIGN PATENT DOCUMENTS

DE 10 2010 019 081 A1 11/2010
EP 0 108 463 A1 5/1984
(Continued)

OTHER PUBLICATIONS

Kraus, D. John et al., "Antennas: For All Applications," Third Edition, p. 339-343.
(Continued)

*Primary Examiner* — Dieu H Duong
(74) *Attorney, Agent, or Firm* — Finnegan, Henderson, Farabow, Garrett & Dunner, LLP

(57) ABSTRACT

The present disclosure relates to an antenna system for wireless communication of data. In one implementation, the system includes at least four horn antennas. Each horn
(Continued)

antenna may have a three-layered cavity, and each layer may be filled with dielectric. The system may further include two microstrip line networks. The microstrip networks may be between two adjacent layered portions and configured to communicate with the horn antennas.

36 Claims, 19 Drawing Sheets

(51) Int. Cl.

| | |
|---|---|
| ***H01Q 13/02*** | (2006.01) |
| ***H01Q 19/08*** | (2006.01) |
| ***H01Q 21/00*** | (2006.01) |
| ***H01Q 15/08*** | (2006.01) |
| ***H01Q 15/24*** | (2006.01) |

(52) U.S. Cl.
CPC ..... *H01Q 15/24* (2013.01); *H01Q 19/08* (2013.01); *H01Q 21/0025* (2013.01); *H01Q 21/0075* (2013.01)

(56) References Cited

U.S. PATENT DOCUMENTS

| | | | | |
|---|---|---|---|---|
| 4,829,314 | A | 5/1989 | Barbier et al. | |
| 5,086,304 | A * | 2/1992 | Collins | H01Q 21/064 343/778 |
| 5,258,768 | A | 11/1993 | Smith | |
| 5,453,751 | A | 9/1995 | Tsukamoto et al. | |
| 5,767,810 | A * | 6/1998 | Hagiwara | H01Q 9/0421 343/700 MS |
| 5,905,457 | A | 5/1999 | Rashid | |
| 5,909,191 | A | 6/1999 | Hirshfield et al. | |
| 6,127,985 | A | 10/2000 | Guler | |
| 6,201,508 | B1 | 3/2001 | Metzen et al. | |
| 6,271,799 | B1 | 8/2001 | Rief et al. | |
| 6,285,335 | B1 | 9/2001 | Snygg et al. | |
| 6,297,774 | B1 | 10/2001 | Chung | |
| 7,135,848 | B1 * | 11/2006 | Ammar | G01K 11/006 324/174 |
| 9,112,279 | B2 | 8/2015 | Montgomery et al. | |
| 2004/0095286 | A1 | 5/2004 | Lee et al. | |
| 2005/0219137 | A1 | 10/2005 | Heisen et al. | |
| 2006/0158382 | A1 | 7/2006 | Nagai | |
| 2006/0270279 | A1 | 11/2006 | Heisen et al. | |
| 2011/0109519 | A1 | 5/2011 | Quan et al. | |

FOREIGN PATENT DOCUMENTS

| | | | | |
|---|---|---|---|---|
| EP | 0 509 214 | A2 | 10/1992 | |
| EP | 1930982 | A1 * | 6/2008 | H01P 1/161 |
| EP | 2 006 956 | A2 | 12/2008 | |
| GB | 2 247 990 | A | 3/1992 | |
| GB | 2 426 876 | A | 12/2006 | |
| WO | WO 2006/019339 | A1 | 2/2006 | |
| WO | WO 2008/069369 | A1 | 6/2008 | |
| WO | WO 2009/031794 | A1 | 3/2009 | |
| WO | WO 2009/037716 | A2 | 3/2009 | |

OTHER PUBLICATIONS

Kraus, D. John et al., "Antennas: For All Applications," Third Edition, p. 126-139.

Bauerle, J. Robert et al., "The Use of a Dielectric Lens to Improve the Efficiency of a Dual-Polarized Quad-Ridge Horn From 5 to 15 GHz," IEEE Transactions on Antennas and Propagation, vol. 57, No. 6, Jun. 2009 p. 1822-1825.

Oh L. L. et al., "Effects of Dielectrics on the Radiation Patterns of an Electromagnetic Horn," IEEE, Transactions on Antennas and Propagation, Jul. 1970, vol. AP-18, No. 4, pp. 553-556.

International Search Report of International Application No. PCT/EP2013/001925, dated Oct. 21, 2013 (3 pages).

International Search Report of International Application No. PCT/EP2013/001923, dated Oct. 21, 2013 (3 pages).

International Search Report of International Application No. PCT/EP2013/001939, dated Nov. 5, 2013 (3 pages).

International Preliminary Report on Patentability and Written Opinion, of International Application No. PCT/EP2013/001925, dated Jan. 6, 2015 (12 pages).

International Preliminary Report on Patentability and Written Opinion, of International Application No. PCT/EP2013/001923, dated Jan. 6, 2015 (10 pages).

International Preliminary Report on Patentability and Written Opinion, of International Application No. PCT/EP2013/001939, dated Jan. 6, 2015 (9 pages).

* cited by examiner

ANTENNA SYSTEM FOR BROADBAND SATELLITE COMMUNICATION IN THE GHZ FREQUENCY RANGE, COMPRISING DIELECTRICALLY FILLED HORN ANTENNAS

This is a U.S. National Phase of PCT/EP2013/001925, filed Jul. 2, 2013, which claims the benefit of priority to German Patent Application No. 10 2012 013 130.5, filed Jul. 3, 2012, the contents of both of which are incorporated herein by reference.

The invention relates to an antenna system for broadband communication between terrestrial radio stations and satellites, particularly for mobile and aeronautic applications.

The need for wireless broadband channels for data transmission at very high data rates, particularly in the field of mobile satellite communication, is constantly increasing. However, particularly in the field of aeronautics, there is a lack of suitable antennas that can satisfy the conditions that are required for mobile use, in particular, such as small dimensions and low weight. For directional, wireless data communication with satellites (e.g. in the Ku or Ka band), there are also extreme requirements for the transmission characteristics of the antenna systems, since interference between adjacent satellites must be reliably prevented.

In aeronautic applications, the weight and the size of the antenna system are of very great importance, since they reduce the payload of the aircraft and give rise to additional operating costs.

The problem is therefore that of providing antenna systems that are as small and lightweight as possible and nevertheless meet the regulatory requirements for transmission and reception operation during operation on mobile carriers.

The regulatory requirements for transmission operation arise from the standards 47 CFR 25.209, 47 CFR 25.222, 47 CFR 25.138, ITU-R M.1643, ITU-R S.524-7, ETSI EN 302 186 or ETSI EN 301 459, for example. All of these regulatory provisions are intended to ensure that no interference between adjacent satellites can arise during directional transmission operation of a mobile satellite antenna. To this end, envelopes (masks) of maximum spectral power density are typically defined on the basis of the separation angle with respect to the target satellite. The values prescribed for a particular separation angle must not be exceeded during transmission operation of the antenna system. This results in stringent requirements for the angle-dependent antenna characteristics. As the separation angle from the target satellite increases, the antenna gain must decrease sharply. This can be achieved physically only by very homogeneous amplitude and phase configuration of the antenna. Typically, parabolic antennas, which have these properties, are therefore used. For most mobile applications, particularly on aircraft, parabolic mirrors have only very poor suitability, however, on account of their size and on account of their circular aperture. In the case of commercial aircraft, for example, the antennas are mounted on the fuselage and must therefore have only the smallest possible height on account of the additional air resistance.

Although antennas that are designed as sections from paraboloids ("banana-shaped mirrors") are possible, they have only very little efficiency on account of their geometry.

By contrast, antenna arrays that are constructed from single radiating elements and have suitable feed networks can be designed using any geometries and any length-to-side ratio without adversely affecting antenna efficiency. In particular, antenna arrays of very low height can be realized.

However, particularly when the reception frequency band and the transmission frequency band are a long way apart (such as in the Ka band with reception frequencies at approximately 18 GHz-21 GHz and transmission frequencies at approximately 28 GHz-31 GHz), the problem arises in antenna arrays that the single radiating elements of the arrays must support very large bandwidth.

It is known that horn antennas are by far the most efficient single radiating elements in arrays. In addition, horn antennas may be of broadband design.

In the case of antenna arrays that are constructed from horn antennas and are fed by pure waveguide networks, however, the known problem of significant parasitic sidelobes (what are known as "grating lobes") arises in the antenna pattern. These grating lobes are caused by the beam centers (phase centers) of the antenna elements that form the antenna array being too great an interval from one another, by virtue of the design, on account of the dimension of the waveguide networks. Particularly at frequencies above approximately 20 GHz, this can result, at particular beam angles, in positive interference between the antenna radiating elements and hence in undesirable emission of electromagnetic power to undesirable solid angle ranges.

If the reception and transmission frequencies are also at frequencies that are a long way apart and if the interval between the beam centers needs to be designed according to the minimum useful wavelength of the transmission band for regulatory reasons, the horn antennas routinely become so small that the reception band can no longer be supported by them.

In the Ka band, for example, the minimum useful wavelength is only approximately 1 cm. So that the radiating elements of the antenna array are dense, that is to say no parasitic sidelobes (grating lobes) arise, the aperture surface area of a square horn antenna may be only approximately 1 cm×1 cm. Conventional horns of this size have only very low performance in a reception band of approximately 18 GHz-21 GHz, however, since the finite opening angle means that they need to be operated close to the cutoff frequency. The Ka reception band can no longer support such horns, or the efficiency thereof decreases very sharply in this band.

In addition, the horn antennas must generally support two orthogonal polarizations, which further restricts the geometric room for maneuver, since an orthomode signal converter, what is known as a transducer, becomes necessary at the horn output. Design of the orthomode signal converter using waveguide technology routinely fails because there is not sufficient installation space available at relatively high GHz frequencies.

If the horn antennas in arrays are packed densely, there is a further problem in that the available installation space behind the horn array cannot accommodate further efficient feed networks.

It is known that feed networks for arrays of horn antennas that are designed using waveguide technology produce only very low dissipative losses. In the optimum case, the individual horn antennas of the arrays are fed by waveguide components and the entire feed network likewise comprises waveguide components. If the reception and transmission bands involve frequencies that are a long way apart, however, the problem arises that conventional waveguides can no longer support the frequency bandwidth that is then required.

By way of example, the required bandwidth in the Ka band is more than 13 GHz (18 GHz-31 GHz). Conventional rectangular waveguides cannot efficiently support such a large bandwidth.

Hence, the following problems arise for mobile, in particular aeronautic, satellite antennas of small size, which need to be solved simultaneously:

1. regulation-compliant antenna pattern without parasitic sidelobes (grating lobes) in the transmission frequency band that allows the operation of the antenna with maximum spectral power density, 2. high antenna efficiency both in the reception band and in the transmission band even with small single radiating element dimensions, 3. efficient feed networks that take up as little installation space as possible and produce the lowest possible dissipative losses, 4. the most compact and space-saving possible design of the antenna with, at the same time, the highest possible antenna efficiency.

If these problems are solved by a suitable arrangement, it is possible to provide a powerful system for large bandwidths even if there is only limited installation space available for a small antenna.

It is known that antennas that are designed as arrays of single radiating elements can be used to achieve grating-lobe-free antenna patterns if the phase centers of the single radiating elements are less than a wavelength of the maximum useful frequency apart. In addition, it is known that parabolic amplitude configurations of such antenna arrays can suppress the sidelobes of the antenna pattern (e.g. J. D. Kraus and R. J. Marhefka, "Antennas: for all applications", 3rd ed., McGraw-Hill series in electrical engineering, 2002). Specific amplitude configurations allow the attainment of an antenna pattern that is optimally matched to the regulatory mask for a given antenna size (e.g. DE 10 2010 019 081 A1; Seifried, Wenzel et. al.).

The object of the invention is to provide a broadband antenna system in the GHz frequency range, particularly for aeronautic applications, that allows regulation-compliant transmission operation with maximum spectral power density over a large bandwidth and at the same time has high antenna efficiency and low background noise in reception operation.

This object is achieved by the antenna system according to claim 1.

According to the invention, the antenna system comprises at least four horn antennas that are completely filled with a dielectric. In accordance with the dielectric properties of the filling, the effective wavelength in the horns then rises and the latter are capable of supporting very much larger bandwidths than would be the case without a filling. Although dielectric fillings result in parasitic losses through the dielectric, these losses remain comparatively small, particularly in the case of very small horns. For applications in the Ka band, for example, a dielectric filling with a dielectric constant of approx. 2 is sufficient. In the case of horns that are just a few centimeters deep, this results in losses of <0.2 dB when suitable materials are used.

In an advantageous embodiment of the antenna system, the dielectric constant (relative permittivity) of the dielectric with which the horn antennas are filled is chosen such that the dielectrically filled horn antennas can still be operated in optimum fashion in the useful band at the lowest frequency in the antenna system. The prerequisite for this is that the wavelengths associated with the lowest useful frequency in the dielectric is still a sufficiently long way above the lowest operating frequency provided by the geometric dimensions of the horn antenna.

If the horn antennas are designed such that no parasitic sidelobes ("grating lobes") arise in the antenna pattern or at least in a section through the antenna pattern of the antenna system, the dimension of the aperture of the horn antennas, at least in one direction, is less than not more than equal to the wavelength $\alpha_s$ of a reference frequency that is in the transmission pattern of the antenna.

If $\lambda_E$ is now the free-space wavelength of the lowest useful frequency, $$\lambda_{E,Medium} = \frac{\lambda_E}{\sqrt{\varepsilon}}, \tag{1}$$

holds the corresponding wavelength in the dielectric when E denotes the dielectric constant (relative permittivity) of the dielectric at the corresponding frequency.

A horn antenna thus works satisfactorily only if at least one aperture dimension is close to the wavelength of the lowest useful frequency, since only then is a regular antenna pattern obtained for the single radiating element. Hence, $$\lambda_{E,Medium} \approx \lambda_S \tag{2}$$

must hold, which together with equation (1) results in the condition $$\varepsilon \approx \left(\frac{\lambda_E}{\lambda_S}\right)^2. \tag{3}$$

However, condition (3) holds for individual isolated horn antennas and is too stringent for antenna systems that are compiled from a plurality of horn antennas, since the reciprocal electromagnetic coupling between the horn antennas is not taken into account.

If the reciprocal coupling is taken into account, it has been found that, for an antenna system that comprises a plurality of dielectrically filled horn antennas, it is optimum if the condition $$\varepsilon \geq \frac{\lambda_E}{\lambda_S} \tag{4}$$

is satisfied. If the antenna system is designed in accordance with condition (4), the antenna system can have very good performance parameters even if the reception and transmission bands of the antenna are at frequencies a long way apart.

According to an advantageous further development of the invention, the single radiating elements support a first and a second polarization and the two polarizations are orthogonal in relation to one another.

According to a further advantageous further development of the invention, the first and second polarizations are linear polarizations.

The signals of the two orthogonal polarizations are routed in separate feed networks, which has the advantage that appropriate components, such as polarizers or 90° hybrid couplers, can be used to send and receive both linearly polarized signals and circularly polarized signals.

So that the antennas may have the smallest possible size and nevertheless regulation-compliant transmission operation with maximum spectral power density becomes possible, one advantageous further development of the invention also provides for at least some of the single radiating elements to be dimensioned such that for the directly adjacent single radiating elements the interval between the phase centers of the single radiating elements is less than or equal to the wavelength of the highest transmission frequency at which no parasitic sidelobes (grating lobes) are permitted to arise (reference frequency in the transmission band).

If at least four adjacent single radiating elements are also situated in different directly adjacent modules, at least one direction is defined by the antenna array, so that for this direction the interval between the phase centers of the single radiating elements is less than or equal to the wavelength of the highest transmission frequency at which no parasitic sidelobes (grating lobes) are permitted to arise.

In this direction, preferably along a straight line for the antenna array, directly adjacent single radiating elements are then dense, which means that no parasitic sidelobes ("grating lobes") can arise in the corresponding section for the antenna pattern. Otherwise, these grating lobes would result in a great reduction in the spectral power density permitted by the regulations.

Suitable single radiating elements are, in principle, all known radiating elements that support two orthogonal polarizations. By way of example, these are rectangular or round horn antennas It is furthermore advantageous if the modules have an at least approximately rectangular geometry, that is to say contain $N_i = n_l \times n_k$ single radiating elements, where $N_i$, n, i, l, k are even numbers, it holds that $$\sum_i N_i = N$$

and N is the total number of single radiating elements. Rectangular modules of this kind can be combined into antenna arrays in a space-saving manner. In addition, the rectangular modules can be relatively easily fed by means of microstrip line networks of binary design.

In order to produce antennas with dissipative losses that are as low as possible, it is advantageous for the single radiating elements to be in the form of horn antennas, which are some of the lowest-loss antennas. In this case, it is possible to use both horn antennas with a rectangular aperture opening and horn antennas with a round aperture opening. If grating lobes are not meant to arise in any section for the antenna pattern, horn antennas with a square aperture opening are advantageous, the size of the aperture opening then being chosen such that the interval between the phase centers of directly adjacent horn antennas is less than or equal to the wavelength of the highest transmission frequency as a reference frequency at which no grating lobes are permitted to arise.

If the horns antennas of the antenna system are dense and if they are of stepped design, a further advantageous embodiment has the apertures of the horn antennas and the steps designed such that the horn antennas operate in optimum fashion both in the reception band and in the transmission band of the antenna.

This can be achieved by virtue of the horn antennas having a rectangular aperture, the two edge lengths of which are less than or no more than equal to the free-space wavelength of a reference frequency that is in the transmission band of the antenna. The surface area available for the antenna system is thus utilized in optimum fashion and the maximum antenna gain is attained.

So that the stepped horns are also optimally matched in the reception band, the horn antennas are designed such that they have at least one rectangular cross section between the aperture (horn opening) and the horn end, wherein $$k_\varepsilon \geq \frac{\lambda_E}{2\sqrt{\varepsilon}}$$

holds for the longer edge $k_E$ of said cross section, $\lambda_E$ denoting the free-space wavelength of the lowest useful frequency and ε denoting the dielectric constant (relative permittivity) of the dielectric filling. This ensures that the lowest useful frequency (typically the lowest reception frequency) is above the lower cutoff frequency of the horn antenna.

In order to attain an optimum match in the transmission band too, the horn antennas furthermore then have a further rectangular cross section at a lower location, wherein $$k_T \geq \frac{\lambda_T}{2\sqrt{\varepsilon}}$$

holds for the longer edge $k_T$ of said cross section, $\lambda_T$ denoting the free-space wavelength of the highest useful frequency. Hence, the highest useful frequency of the antenna (typically the maximum transmission frequency) is above the "cutoff" frequency at the horn end too.

In order to attain bandwidths that are as large as possible, it is also advantageous if the single radiating elements are in the form of horn antennas such that they are equipped with symmetrical geometric constrictions in the two polarization planes and, at their output, are fed via the geometric constriction associated with the respective polarization direction for each of the two orthogonal polarizations separately. Such geometric constrictions can greatly increase the bandwidth of the horns.

If the transmission and reception bands are at frequencies that are a long way apart, the horn antennas are, according to a further advantageous refinement of the invention, designed as stepped horns. Setting the width and length of the steps, and also the number of steps, then allows the antenna to be optimally matched to the respective useful frequency bands.

In order to achieve a high level of cross polarization decoupling, it is furthermore advantageous if the horn antennas are designed such that they support two orthogonal linear polarizations. Such horn antennas can be used to achieve isolations of far more than 40 dB. Particularly in the case of signal codings with high spectral efficiency, such isolation values are necessary.

A further improvement in the reception power, particularly in the case of very small horn antennas, can be achieved by virtue of the individual horn antennas being equipped with a dielectric cross septum or a dielectric lens. The insertion loss ($S_{11}$) in the reception band can be significantly reduced by such structures, specifically even if the aperture surface areas of the single radiating elements are so very small that a free-space wave would, without these additional dielectric structures, already be reflected almost completely.

Since, in the case of parallel-fed single radiating elements, the dissipative losses, for example as a result of a dielectric filling, arise only once, horn antennas of the antenna array are, according to a further advantageous further development of the invention, fed in parallel. This is most effective when the microstrip lines and the waveguides are constructed as binary trees, since the number of power dividers required is thus minimized in the general case of arbitrary values of the total number of single radiating elements N and arbitrary values of the number of single radiating elements in a module $N_i$.

In this case, the binary trees are, in the general case, neither complete nor completely symmetrical.

If, however, according to an advantageous further development of the invention, $N_i=2^{n_i}$, where $n_i$ is an integer number, for all the modules of the antenna system or at least for the majority of the modules, then the number of power dividers required can be further reduced because in that case some of the binary trees are complete at any rate.

It is particularly beneficial if, in addition, $N=2^n$, where n corresponds to an integer number. In that case, the feed networks of the antenna system can be designed as complete and completely symmetrical binary trees and all the single radiating elements can have the same length of feed lines, i.e. including very similar attenuations.

It is also advantageous if the microstrip lines are situated on a thin substrate and are routed in closed metal cavities, the cavities typically being filled with air. In this case, a substrate is typically referred to as thin if its thickness is less than the width of the microstrip lines.

This design—similar to a coaxial line—with typically air as a filling results in comparatively low-loss high-frequency lines. It has thus been found that the dissipative losses of such lines, e.g. at Ka band frequencies, are only approximately a factor 5 to 10 higher than the losses of waveguides. Since these lines are used only for comparatively short distances, the absolute losses remain comparatively low. The noise contribution of such lines to the background noise of the system therefore also remains relatively low.

The production of densely packed antenna systems can be greatly facilitated by virtue of their being constructed from a plurality of layers and the microstrip line networks of the two orthogonal polarizations being situated between two different layers. The modules of the antenna system can then be assembled from a few layers. Advantageously, the layers are made from aluminum or similar electrically conductive materials that can be structured using the known structuring methods (milling, etching, lasering, wire eroding, water cutting, etc.). The microstrip line networks are structured using known etching methods on a substrate.

Advantageously, the cavities through which the microstrip lines are routed are structured directly with the metal layers. If the cavities are designed as notches or depressions in the respective metal layers situated above and below the microstrip line, the microstrip line is situated together with its substrate in a cavity that comprises two half-shells. The walls of the cavity can be electrically closed by virtue of the substrate being provided with electrical plated-through holes (vias). "Fences" of vias can in this case prevent the loss of electromagnetic power almost completely in such arrangements.

If the reception and transmission bands of the antenna are at frequencies that are a very long way apart, it may be the case that standard waveguides (rectangular waveguides) are no longer able to support the necessary bandwidth. In this case, it is advantageous to provide the waveguides with geometric constrictions along the direction of propagation of the electromagnetic wave. Such constrictions can greatly increase the useful bandwidth. In this case, the number and arrangement of the constrictions are dependent on the design of the antenna system.

In the case of very large useful bandwidths, what are known as double-ridged waveguides are advantageous, which can have a significantly larger bandwidth than standard waveguides. These waveguides have a geometric constriction parallel to the supported polarization direction, which prevents parasitic higher modes from arising.

In the case of very high useful frequencies or very dense single radiating elements, one advantageous further development of the invention involves dielectrically filled waveguides being used for the waveguide feed networks. Such waveguides require much less installation space than air-filled waveguides. Depending on requirements for the installation space, it is additionally possible for some of or an entire waveguide network to comprise dielectrically filled waveguides in this case. Partial filling is also possible.

For further processing of the signals, e.g. by coupling a low-noise amplifier (LNA) to the reception feed network and/or a power amplifier ("high power amplifier" HPA) to the transmission feed network, it may be advantageous to equip the feed networks with frequency diplexers. Such frequency diplexers separate the reception band from the transmission band. In this case, the waveguide diplexers, in particular, are advantageous because they can achieve a very high level of isolation and also have very low attenuation.

The point at which the frequency diplexers are inserted into the feed networks is dependent on a respective instance of application. By way of example, it is conceivable for each module of the antenna array to have its output or input equipped directly with a diplexer. The input or output of these diplexers then has all the signal combinations in pure form: polarization 1 in a reception band, polarization 2 in a reception band, polarization 1 in the transmission band and polarization 2 in the transmission band. The modules can then be connected to one another by four appropriate waveguide feed networks. This embodiment has the advantage that the waveguide feed networks do not need to cover a very wide band of frequencies because they each need to be suitable only for signals in the reception or transmission band.

However, it is also conceivable for the frequency diplexers each merely to be mounted at the input or output of the waveguide networks. Such an embodiment saves installation space, but typically requires a broadband design of the waveguide networks.

For applications in which transmission and reception are intended to take place in different polarizations, or in the case of applications in which the polarization of the transmission or received signal changes dynamically ("polarization diversity"), it is advantageous if both the intra-modular microstrip line networks and the inter-modular waveguide networks are designed such that they can support the transmission and reception bands simultaneously.

If the antenna is provided with frequency diplexers that are connected to a suitable high-frequency switching matrix, then dynamic changeover between the orthogonal polarizations is possible ("polarization switching").

Such embodiments are advantageous particularly when the antenna is intended to be used in satellite services that use what is known as "spot beam" technology. "Spot beam" technology gives rise to coverage areas (cells) of relatively small surface area (typical diameter in the Ka band approx. 200 km-300 km) on the earth's surface. In order to be able to use the same frequency bands in adjacent cells ("frequency re-use"), adjacent cells are distinguished merely by the polarization of the signals.

When the antenna is used on rapidly moving carriers, particularly on aircraft, a very large number of and very rapid cell changes then typically occur and the antenna must be capable of quickly changing over the polarization of the received and transmission signals.

If, by contrast, the antenna is used in satellite services in which the polarization of the received or transmission signal is fixed and changes neither over time nor geographically, it is advantageous if the first intra-modular microstrip line network and the associated inter-modular waveguide network are designed for the reception band of the antenna, and the second intra-modular microstrip line network and the associated inter-modular waveguide network are designed for the transmission band of the antenna system.

This embodiment has the advantage that the respective feed networks can be optimized for the respective useful frequency band, and hence a very low-loss antenna system with very high performance is produced.

If the radiating elements of the antenna system are designed for two orthogonal linear polarizations, the feed networks are, according to one advantageous refinement of the invention, equipped with what are known as 90° hybrid couplers. In this case, 90° hybrid couplers are four-port networks that convert two orthogonal linearly polarized signals into two orthogonal circularly polarized signals, and vice versa. Such arrangements can then be used to send and receive circularly polarized signals too.

Alternatively, the antenna array can also be equipped with what is known as a polarizer for the purpose of receiving and sending circularly polarized signals. Typically, these are suitably structured metal layers that are situated in one plane approximately perpendicular to the direction of propagation of the electromagnetic wave. In this case, the effect of the metal structure is that it acts capacitively in one direction and inductively in the orthogonal direction. For two orthogonally polarized signals, this means that a phase difference is impressed on the two signals. If the phase difference is now set such that it is precisely 90° before the pass through the polarizer, two orthogonal linearly polarized signals are converted into two orthogonally circularly polarized signals, and vice versa.

In order to obtain large useful bandwidths, the polarizer advantageously comprises a plurality of layers that are mounted at a particular interval (typically in the region of one quarter wavelength) from one another.

A particularly suitable embodiment of the polarizer is a multilayered meander line polarizer. In this case, the usual structuring methods are used to structure metal meander structures of suitable dimension on a typically thin substrate. The substrates structured in this manner are then adhesively bonded onto foam plates, or laminated in sandwiches. Examples of suitable foams are low-loss closed-cell foams such as Rohacell or XPS.

Advantageously, a succession of foam plates, adhesive films and structured substrates can be laid on top of one another in this case and pressed with a press. A suitable low-weight polarizer is then obtained in a relatively simple manner.

According to a further advantageous refinement of the invention, very high useful bandwidths and high cross polarization isolations are achieved if the polarizer is mounted not precisely perpendicular to the direction of propagation of the electromagnetic wave in front of the antenna array but rather in slightly tilted fashion. In these arrangements, the typical interval between the polarizer and the aperture surface area of the antenna array is in the region of a wavelength of the useful frequency, and the tilted angle with respect to the aperture plane is in the range from 2° to 10°.

Since the antenna pattern of the antenna system must, in the transmission band, be below a mask prescribed by the regulations, and in the case of small antennas can be sent with high spectral power densities only when the pattern is as close as possible to the mask, it may be advantageous for the antenna system to be provided with an amplitude configuration ("aperture amplitude tapering"). Particularly in the case of planar aperture openings, parabolic amplitude configurations of the aperture are particularly suited to this. Parabolic amplitude configurations are in this case characterized in that the power contributions of the single radiating elements increase on the edge of the antenna array to the center and, by way of example, a parabola-like profile is obtained.

Such amplitude configurations of the antenna array result in suppression of the sidelobes in the antenna pattern and hence in a higher spectral power density permitted by the regulations.

Since, in the case of applications in geostation satellite services, the sidelobes need to be suppressed only along a tangent to the geostation orbit at the location of the target satellite, the amplitude configuration of the antenna system is preferably designed such that it has an effect at least along that direction for the antenna system in which the radiating elements are dense. In this case, the radiating elements are dense in the direction in which the interval between the phase centers of the single radiating elements is less than or equal to the wavelength of the highest transmission frequency at which no significant parasitic sidelobes (grating lobes) are permitted to arise.

In addition, further advantages and features of the present invention become evident from the description of preferred embodiments. The features described therein can be implemented on their own or in combination with one or more of the aforementioned features. The description below of the preferred embodiments is provided with reference to the accompanying drawings.

Figure 1A:
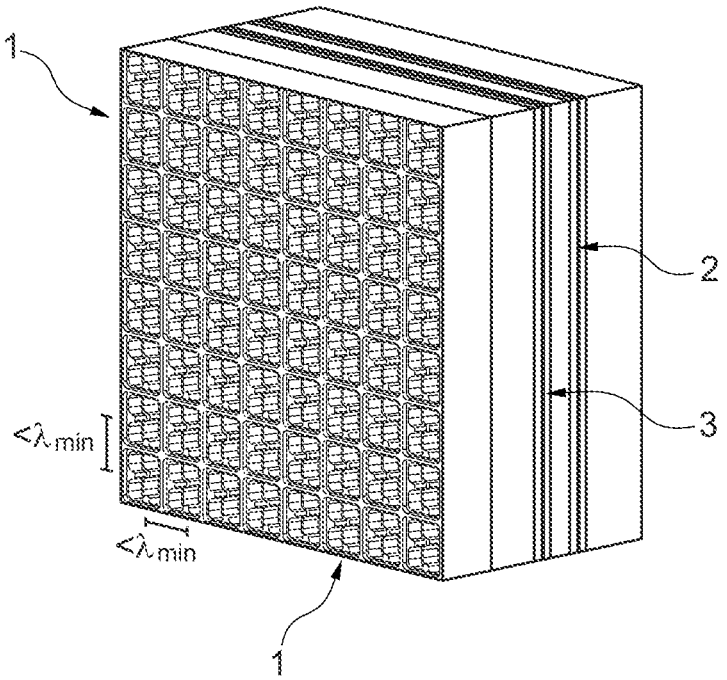
FIG. 1*a-b* schematically show an inventive antenna module that comprises an array of 8×8 single radiating elements.

The exemplary embodiments of the antenna and of the components thereof that are shown in the drawings are explained in more detail below.

FIG. 1 shows an exemplary embodiment of an antenna module of an inventive antenna. The single radiating elements 1 are in this case designed as rectangular horn antennas that can support two orthogonal polarizations.

The intra-modular microstrip line networks 2, 3 for the two orthogonal polarizations are situated between different layers.

The antenna module comprises a total of 64 primary single radiating elements 1 that are arranged in an 8×8 antenna array ($N_i$=64). The dimensions of the single radiating elements and the size of their aperture surface areas is chosen such that the interval between the phase centers of the individual radiating elements along both main axes is less than $\lambda_{min}$, where $\lambda_{min}$ denotes the wavelength of the highest useful frequency. This interval ensures that parasitic sidelobes, what are known as "grating lobes", can't arise in any direction up to the maximum useful frequency (reference frequency) in the antenna pattern.

In the exemplary case of the antenna module shown in FIG. 1, the two microstrip line networks are a 64:1 power divider, since they bring together the signals from 64 single radiating elements. An exemplary internal organization of the two microstrip line networks is shown in FIG. 2.

However, embodiments are also conceivable for which the modules comprise a lower or higher number of horn antennas. For K/Ka band antennas, 4×4 modules are best, for example. The microstrip line networks are then a 16:1 power divider that brings together the signals from 16 single radiating elements. In this case, the microstrip lines are relatively short and their noise contribution therefore remains small.

Depending on the application, appropriate design of the module sizes therefore allows an antenna having optimum power parameters to be built. Advantageously, the modules are made only as large as necessary in order to be able to feed them using waveguides. The parasitic noise contribution of the microstrip lines is minimized thereby.

Figure 1B:
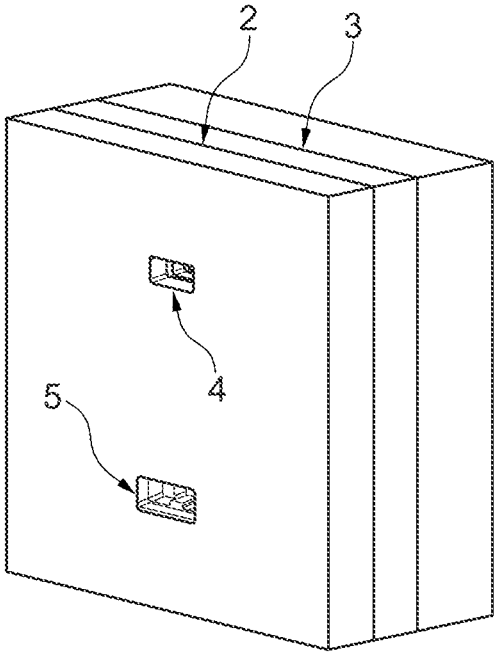
Figure 2A:
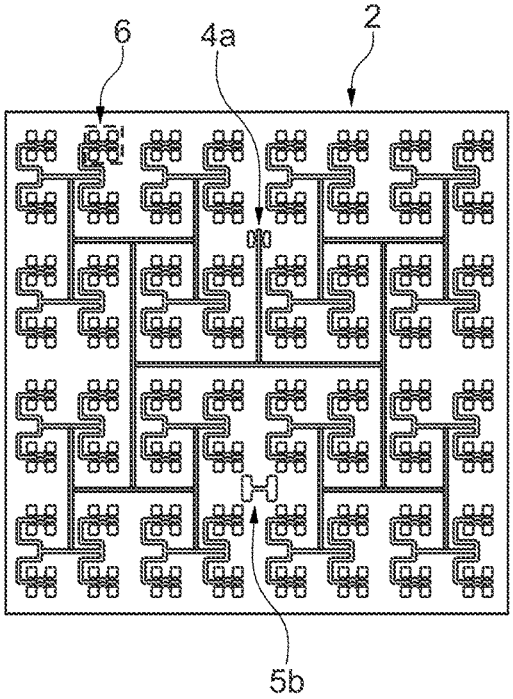
FIG. 2*a-b* show exemplary microstrip line feed networks for an 8×8 antenna module.
Figure 2B:
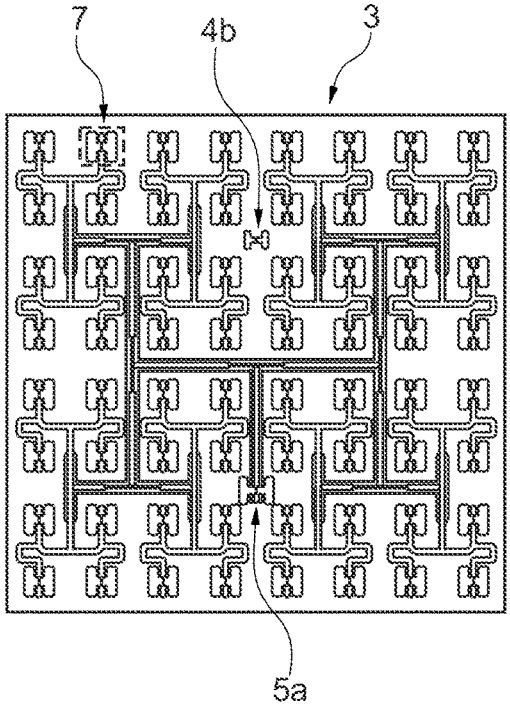

The two microstrip line networks 2, 3 couple the signals that have been brought together, in each case separated according to polarizations, into microstrip-to-waveguide couplings 4, 5, as shown in FIG. 1*b*. These waveguide couplings 4, 5 allow any number of modules to be coupled to form an inventive antenna system efficiently and with low attenuation using waveguide networks.

FIG. 2 shows two exemplary microstrip line networks 2, 3 for feeding the single radiating elements 1 of the 8×8 antenna module in FIG. 1. The two networks are designed as binary 64:1 power dividers.

The two mutually orthogonal microstrip-to-waveguide couplings 6, 7 couple the orthogonally polarized signals into or out of the individual horn antennas of the 8×8 module. The summed signal is coupled into or out of waveguides at the waveguide couplings 4*a* and 5*a*. Since the two microstrip line networks 2, 3 are typically situated above one another in two planes, waveguide bushes 4*b* and 5*b* are likewise situated on the relevant board in order to provide a perforation and the connection to the waveguide couplings 4*a* and 5*a*.

The microstrip line networks 2, 3 can be produced using all known methods, low-loss substrates being particularly suitable for antennas.

FIG. 3 shows by way of example how various antenna modules 8 can be coupled to form inventive antenna systems.

Inventive antenna systems comprise a number M of modules, M needing to be at least two. FIG. 3 shows modules having $N_i$=8×8=64 (i=1, . . . , 16) single radiating elements 1 by way of example. M is equal to 16 and the modules are arranged in an 8×2 array (cf. FIG. 3*a*), resulting in a rectangular antenna having N=

$$\sum_i N_i = 64 \times 16 = 1024$$

single radiating elements. Other arrangements of the modules and other module sizes are likewise conceivable, however. It is also possible for the modules also to be arranged in a circle, for example. It is also not necessary for all the modules to have the same size (number of single radiating elements).

The modules 8 are then connected up to one another using the waveguide networks 9, 10. To this end, the relevant waveguide input coupling points 11, 12 of the waveguide networks 9, 10 are connected to the relevant waveguide couplings 4, 5 (cf. FIG. 1*b*) of the individual modules 8.

The waveguide networks 9, 10 themselves are each individually an M:1 power divider, so that the two orthogonally polarized signals can be fed into the antenna system and coupled out of the antenna system via the sum ports 13, 14.

Depending on the application and the required frequency bandwidth, a wide variety of waveguides, such as conventional rectangular or round waveguides or more broadband, ridged waveguides, can be used for the waveguide networks 9, 10. Dielectrically filled waveguides are also conceivable.

By way of example, it may thus be advantageous for the portion of the waveguide network that directly adjoins the waveguide coupling 4, 5 to be filled with a dielectric. The dimensions of the dielectrically filled waveguides are then reduced considerably, which means that the installation space requirement therefore is minimized.

The antenna shown in FIG. 3 is therefore designed in accordance with claim 1:

the antenna comprises an antenna array of N single radiating elements 1, each single radiating element 1 being able to support two independent orthogonal polarizations, and N denoting the total number of single radiating elements 1 of the antenna array.

In addition, the antenna array is constructed from modules 8, with each module containing $N_i$ single radiating elements, and it holding that $$\sum_i N_i = N.$$

In the exemplary embodiment in FIG. 3, it is additionally true in this case that each module contains $N_i = n_l \times n_k$ single radiating elements, $N_i$, n, i, l, k are integers and it holds that $$\sum_i N_i = N.$$

The single radiating elements 1 are dimensioned such (see FIG. 1) that for at least one direction through the antenna array the interval between the phase centers of the horn antennas is less than or equal to the wavelength of the highest transmission frequency at which no grating lobes are permitted to arise.

The single radiating elements 1 are fed by microstrip lines for each of the two orthogonal polarizations separately (see FIG. 2, microstrip-to-waveguide couplings 6, 7).

The microstrip lines of one orthogonal polarization are connected to the first intra-modular microstrip line network 2, and the microstrip lines of the other orthogonal polarization are connected to the second inter-modular microstrip line network 3.

The first intra-modular microstrip network 2 is coupled to the first inter-modular waveguide network 9, and the second intra-modular microstrip network 3 is coupled to the second inter-modular waveguide network 10, so that the first inter-modular waveguide network 9 brings together all the signals of one orthogonal polarization at the first sum port 13 and the second intermodular waveguide network 10 brings together all the signals of the other orthogonal polarization at the second sum port 14.

In addition, the microstrip line networks 2, 3 and the waveguide networks 9, 10 are in this case designed as complete and completely symmetrical binary trees, so that all the single radiating elements 1 are fed in parallel.

Figure 3A:
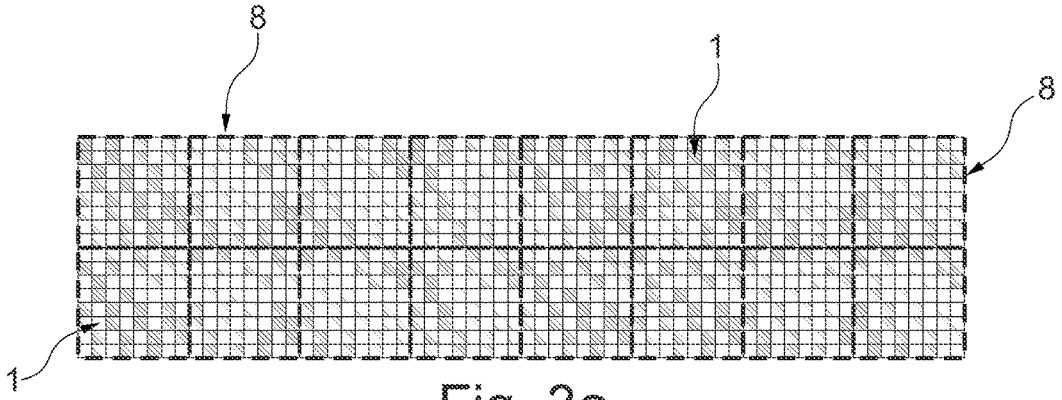
FIG. 3*a-d* schematically show the exemplary design of an inventive antenna comprising antenna modules, and the networking of the modules by waveguide networks.
Figure 3B:
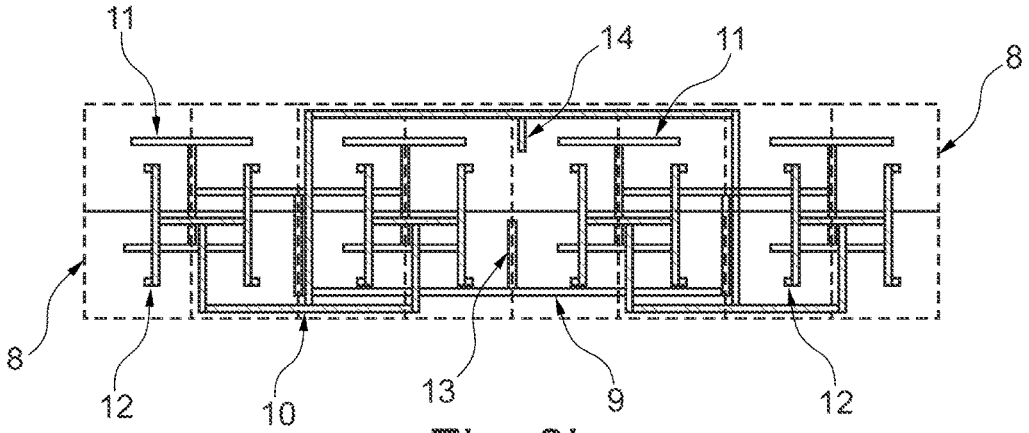
Figure 3C:
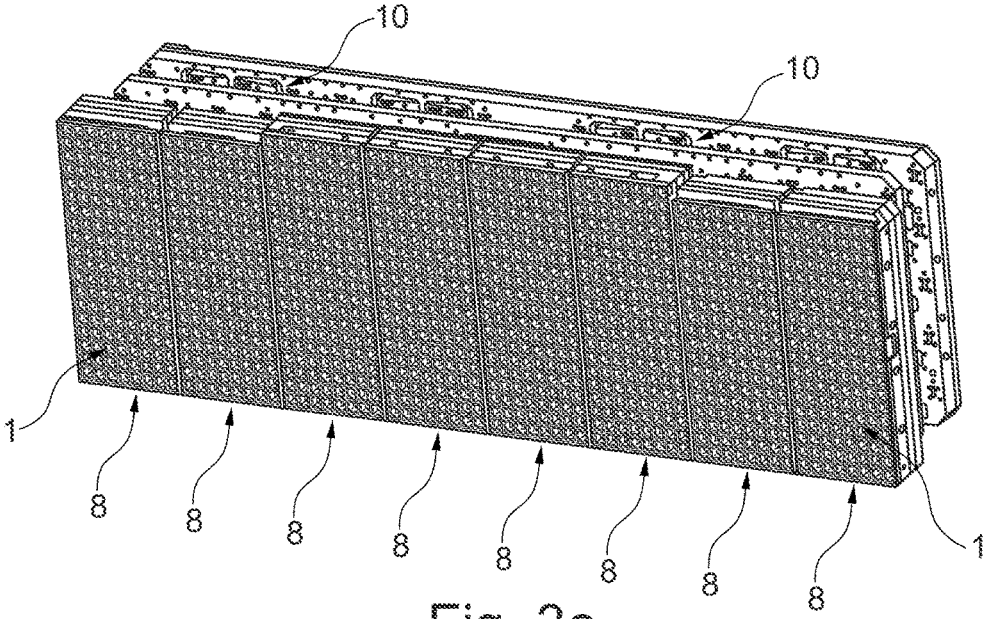
Figure 3D:
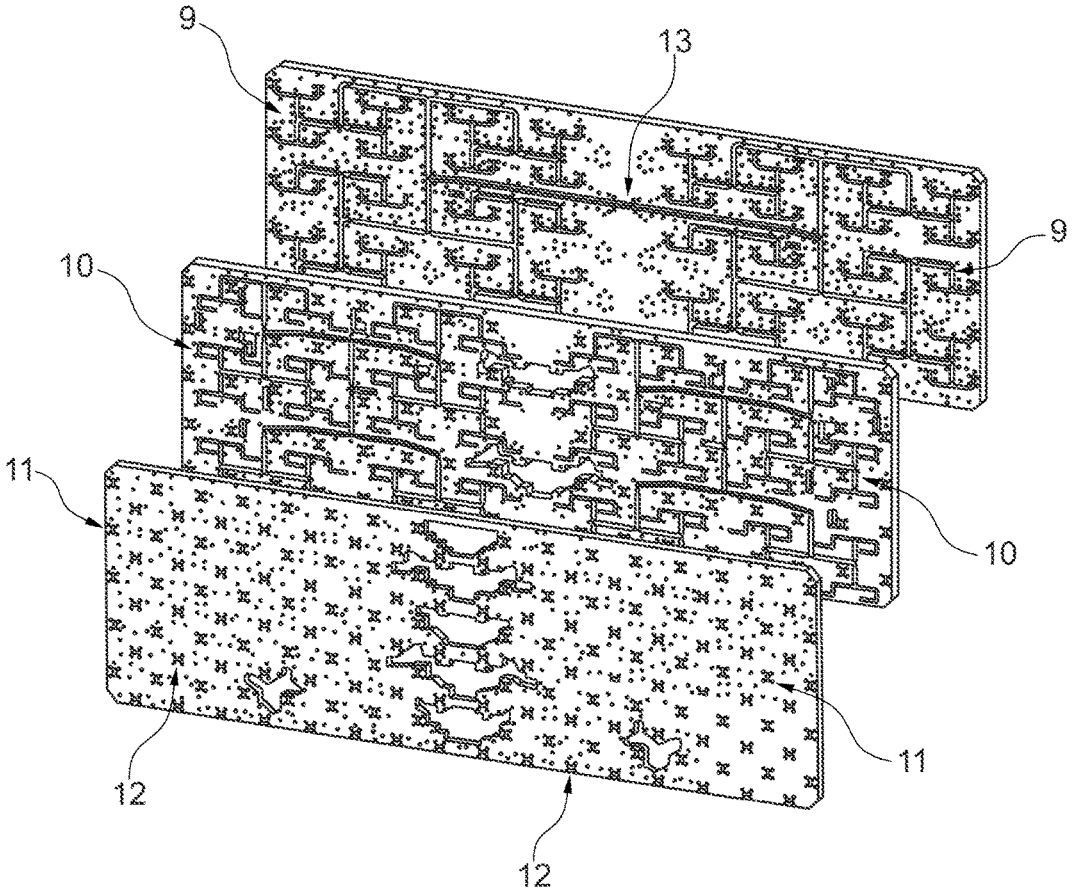

FIGS. 3*c* and 3*d* show a physical implementation of a corresponding antenna system. The modules 8 comprise single radiating elements 1 and have two different sizes, i.e. the number of single radiating elements 1 per module 8 is not the same for all the modules 8. The middle four modules 8 each have 8 single radiating elements 1 more than the other four modules 8. This results in the height of the antenna system at the left-hand and right-hand edges being lower than in the central region. Such embodiments are advantageous particularly when the antenna system needs to be matched in optimum fashion to an aerodynamic radom.

The modules 8 are fed by two waveguide networks 9 and 10 for each polarization separately. In this case, the waveguide networks 9, 10 are situated in two separate layers behind the modules, and the modules are connected to the waveguide networks 9, 10 by the input coupling points 11, 12 that are coupled to the waveguide couplings of the modules 4, 5. The two waveguide networks 9, 10 are implemented as milled-out features in this case.

If the transmission and reception bands of the antenna system are at frequencies that are a long way apart, the case may arise in which the dimensions of the single radiating elements 1 of the array need to be so small that the lower of the two frequency bands comes close to the cutoff frequency of the single radiating elements 1, or is even below it. By way of example, conventional horn antennas are then no longer able to support this frequency band, or efficiency of said horn antennas decreases sharply.

In the case of K/Ka band operation, for example, the reception frequency band is thus approx. 19 GHz-20 GHz and the transmission frequency band is approx. 29 GHz-30 GHz. To meet the condition that the antenna pattern is free of parasitic sidelobes ("grating lobes") in the transmission band, the aperture of the single radiating elements 1 must be no more than 1 cm×1 cm in size ($\lambda_{min}$ is 1 cm).

Conventional dual-polarized horn antennas having an aperture opening of just 1 cm×1 cm, for example, more or less stop operating at 19 GHz-20 GHz ($\lambda_{max}$=1.58 cm), however, because acceptable impedance matching to free space is no longer possible. In addition, the horn antenna would need to be operated very close to the lower cutoff frequency, which would result in very high dissipative losses and in very low antenna efficiency.

It may therefore be advantageous for the primary single radiating elements 1 to be designed as ridged horn antennas. Such horn antennas may have a greatly extended frequency bandwidth in comparison with conventional horn antennas.

The impedance matching of such ridged horns to free space is then carried out using methods from antenna physics. The ridged horns may in this case be designed such that they may support two orthogonal polarizations. By way of example, this is achieved by virtue of the horns being symmetrically quad-ridged. The signals of the orthogonal polarizations are routed to and fro by separate microstrip line networks 2, 3.

Figure 4A:
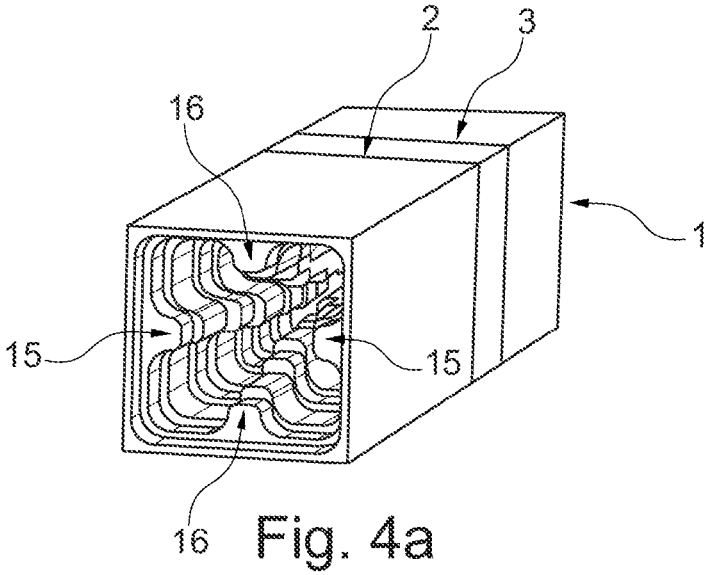
FIG. 4*a-d* show the detailed design of a single quad-ridged horn antenna.

FIG. 4*a* schematically shows the detailed design of a horn antenna equipped with symmetrical geometric constrictions using the example of a quad-ridged horn antenna 1. The horn antenna 1 comprises three segments (layers) with the two microstrip line networks 2, 3 being situated between the segments.

The horn antennas 1 are equipped with symmetrical geometric constrictions 15, 16 in accordance with the orthogonal polarization directions, which extend along the direction of propagation of the electromagnetic wave.

Such horns are referred to as "ridged" horns. FIG. 4*a* shows an exemplary quad-ridged single horn that can support two orthogonal polarizations on a broadband basis.

Figure 4B:
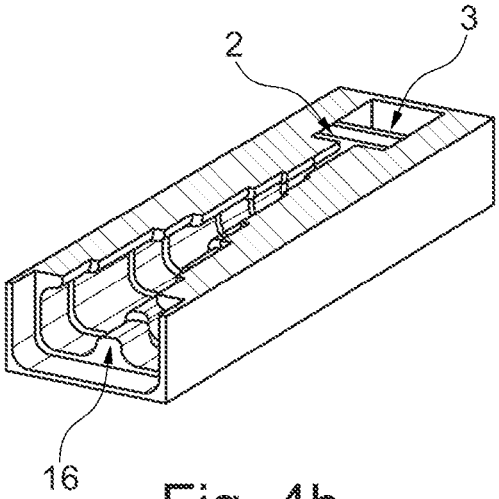
Figure 4C:
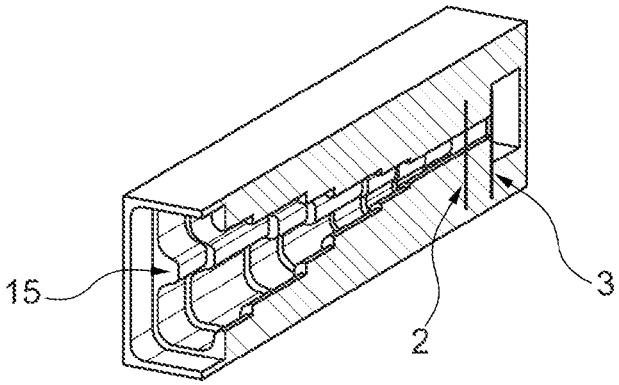

As the sections in FIGS. 4*b* and 4*c* show, the geometric constrictions are of stepped design and the interval between the constrictions 15, 16 becomes shorter in the direction of the input and output coupling points. This allows a very large frequency bandwidth to be achieved. In particular, horn antennas 1 can be produced that are also able to support transmission and reception bands that are at frequencies that are a long way apart without significant losses in efficiency. An example of these are K/Ka band satellite antennas. In this case, the reception band is 18 GHz-21 GHz and the transmission band is 28 GHz-31 GHz.

The depth, width and length of the steps is geared to the desired useful frequency bands and can be determined by means of numerical simulation methods.

The input and output coupling of the signals to and from the microstrip line networks 2, 3 typically take place at the narrowest point of the constrictions 15, 16 for the respective polarization direction, which allows very broadband impedance matching.

Figure 4D:
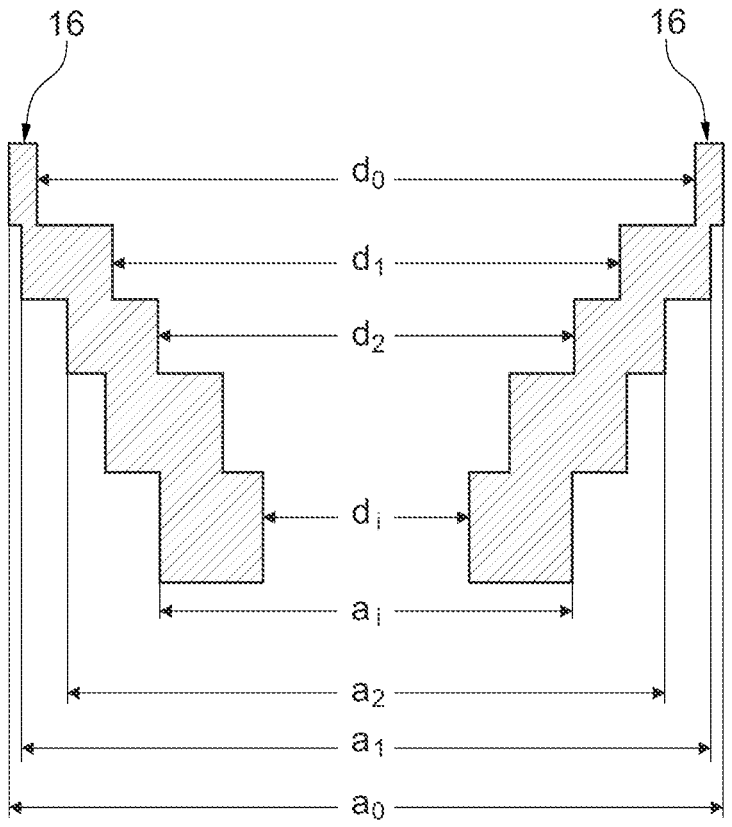

FIG. 4*d* schematically shows a portion of the longitudinal sections through a ridged horn at the location of two opposite constrictions 16. The constrictions 16 are of stepped design and the interval $d_i$ between opposite steps decreases from the aperture of the horn antenna (top end) to the horn end (bottom end).

In addition, the horn itself is stepped (cf. FIG. 4*a-c*), so that for each step the edge length $a_i$ of the horn opening likewise decreases in the corresponding cross section from the aperture of the horn antenna to the horn end.

The intervals $d_i$ and the associated edge lengths $a_i$, or at any rate at least some of them, are now designed such that the associated lower cutoff frequency of the respective ridged waveguide section is below the lowest useful frequency of the horn antenna. Only when this condition is met can the electromagnetic wave of the corresponding wavelength enter the horn antenna as far as the waveguide-to-microstrip line coupling, and be coupled in or out at that point.

Since the dissipative attenuation greatly increases as the lower cutoff frequency is approached, the intervals $d_i$ and the associated edge lengths $a_i$ are advantageously chosen such that an adequate interval from a cutoff frequency remains and the attenuation does not become too high.

In addition, there must be allowance for reciprocal coupling from the radiating elements to be in effect in antenna systems that comprise a plurality of horn antennas.

Figure 5:
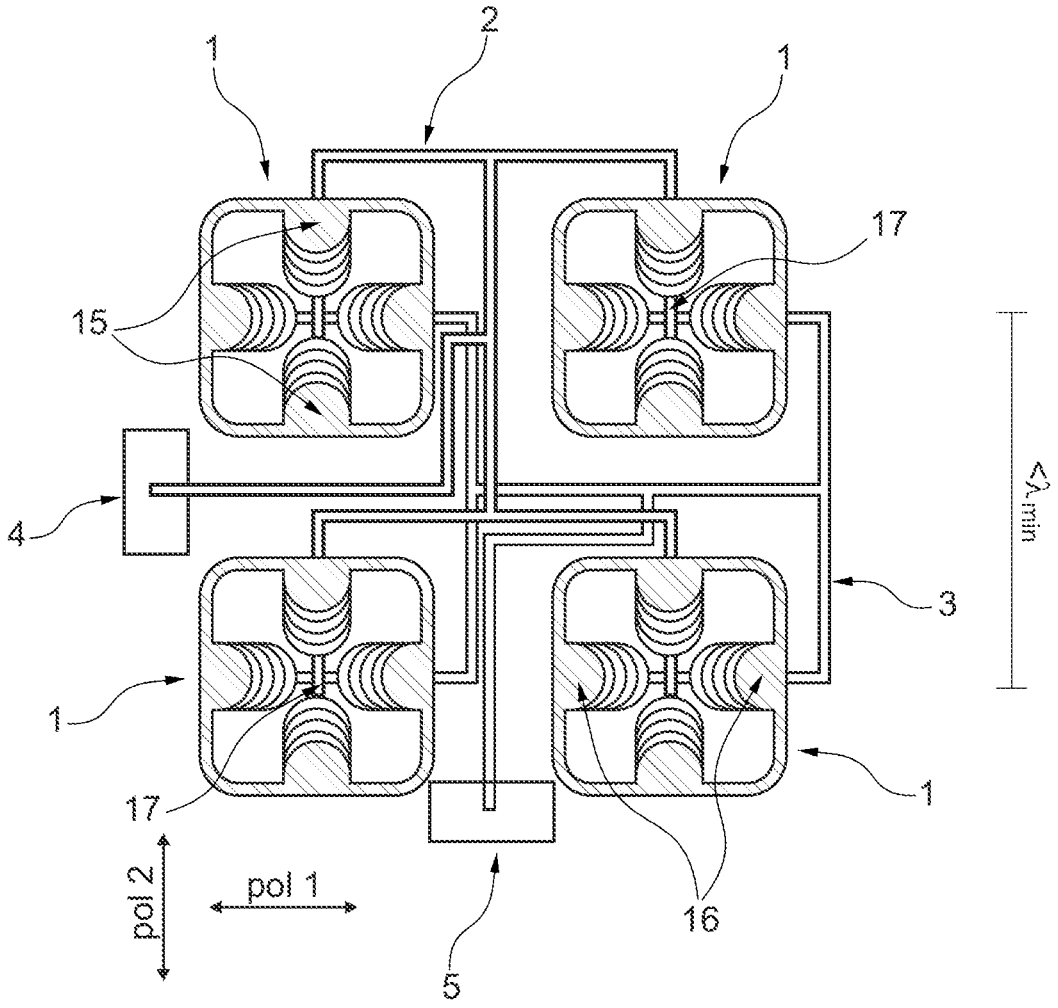
FIG. 5 schematically shows the detailed design of a 2×2 antenna module comprising quad-ridged horn antennas.

FIG. 5 schematically shows the inventive design of a 2×2 antenna module that comprises four quad-ridged horn antennas 1, four output coupling points 17 for the microstrip line networks 2, 3, two microstrip line networks 2, 3 separated for each of the two orthogonal polarizations, and output coupling points from the microstrip line networks 2, 3 to the waveguide coupling 4, 5. The constrictions as symmetrical ridging 15, 16 of the horn antennas 1 are likewise shown.

The two orthogonally polarized signals pol 1 and pol 2, the reception and radiation of which is supported by the horn antennas 1, are fed into and extracted from the relevant microstrip line network 2, 3 by the output and input coupling points 17.

The microstrip line networks 2, 3 in turn are designed as binary 4:1 power dividers and couple the summed signals into the waveguides 4, 5.

The interval between the phase centers of two adjacent horn antennas 1 in a vertical direction is less than $\lambda_{min}$ in this case, which means that at least in this direction no undesirable parasitic sidelobes ("grating lobes") can arise in the antenna pattern and the horn antennas are dense in this direction.

In the example shown in FIG. 5, the phase centers of the horn antennas 1 coincide with the beam centers of the horn antennas 1. Generally, this is not necessarily the case, however. The situation of the phase center of a horn antenna 1 of an arbitrary geometry can be determined using numerical simulation methods, however.

The known broadband nature of microstrip lines makes them particularly suitable for the input and output coupling of the signals supported by the ridged horn antennas 1. In addition, microstrip lines require only very little installation space, which means that highly efficient, broadband horn-antenna antenna systems whose antenna patterns have no parasitic sidelobes ("grating lobes") can also be implemented for very high frequencies (e.g. 30 GHz-40 GHz).

Figure 6A:
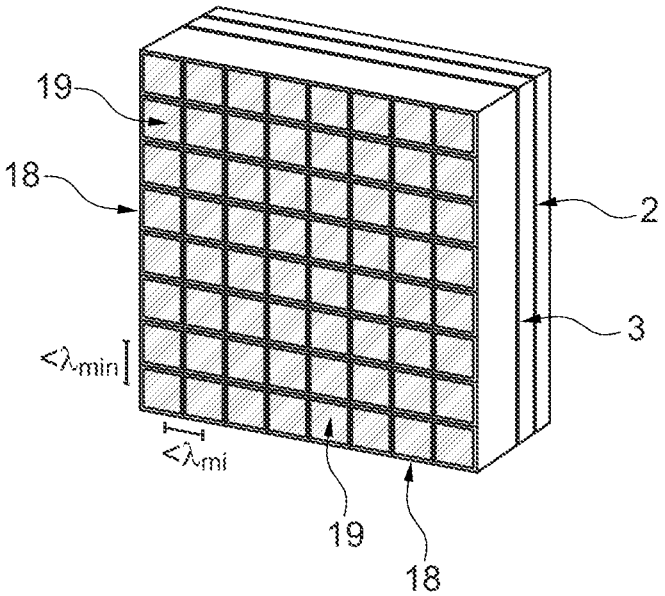
FIG. 6*a-b* show an exemplary 8×8 antenna module that comprises dielectrically filled horn antennas.
Figure 6B:
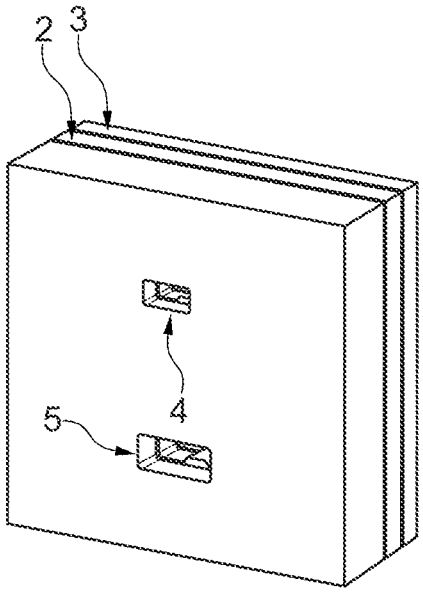

In FIG. 6, the antenna modules are constructed from dielectrically filled horn antennas 18. The horn antennas 18 filled with a dielectric 19 are in this case arranged in an 8×8 antenna array by way of example and are coupled to one another via the microstrip line networks 2 and 3.

The microstrip line networks 2, 3 couple the summed signals into the waveguide couplings 4, 5.

Figure 7A:
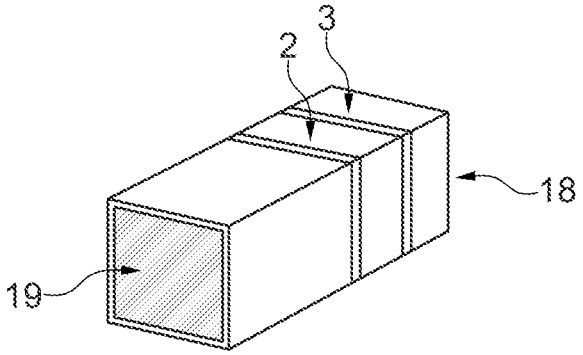
FIG. 7*a-d* show the exemplary detailed design of a single dielectrically filled horn antenna.
Figure 7B:
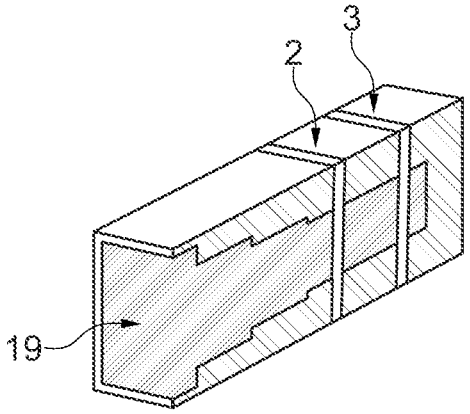
Figure 7C:
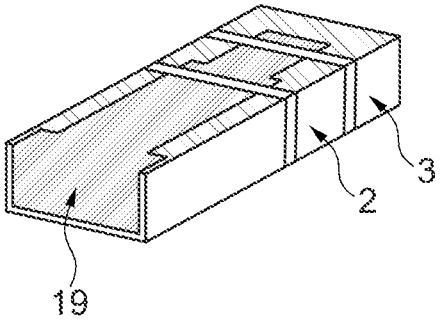

FIG. 7*a-c* show the internal design of a single horn antenna 18 that is completely filled with a dielectric. Like the horn antenna 18 itself, the dielectric filling body (dielectric) 19 also comprises three segments that are each defined by the microstrip line networks 2, 3.

So that the single radiating elements 1 are able to support two frequency bands that are a long way apart, they have their interior of stepped design, as shown by way of example in the sections in FIG. 7*b-c*. The highest frequency band is coupled out and in typically at the narrowest or lowest point by the microstrip line network 3 that is furthest away from the aperture opening of the single radiating element 1. The lower frequency band is coupled out and in at a point situated further toward the aperture opening, by a microstrip line network 2.

The depth, width and length of the steps is geared to the desired useful frequency bands and can be determined using numerical simulation methods in this case too.

If the two input and output coupling points of the microstrip line networks 2, 3 are sufficiently close to one another in physical terms, however, the horn antenna 1 can also be designed such that the two inputs and outputs can support both the transmission and the reception frequency band.

The dielectric filling body 19 is likewise of stepped design so as to ensure a corresponding precise fit. The shape of the filling body 19 at the aperture surface is geared to the electromagnetic requirements for the antenna pattern of the single radiating element 1. As shown, the filling body 19 can be of planar design at the aperture opening. However, other designs, for example, inwardly or outwardly curved, are also possible.

Suitable dielectrics are a wide variety of known materials such as Teflon, polypropylene, polyethylene, polycarbonate or polymethylpentene. For simultaneous coverage of the K and Ka bands, for example, a dielectric having a dielectric constant of approximately 2 is sufficient (e.g. Teflon, polymethylpentene).

In the exemplary embodiment shown in FIG. 7, the horn antenna 18 is completely filled with a dielectric 19. However, embodiments with just partial filling are also possible.

The advantage of the use of dielectrically filled horns is that the horns themselves have a much less complex inner structure than in the case of ridged horns.

In order to produce highly efficient antennas even at very high GHz frequencies, however, it is also conceivable for quad-ridged horn antennas, for example, to be filled with a dielectric. Other horn geometries with dielectric filling or partial filling are also possible.

Figure 7D:
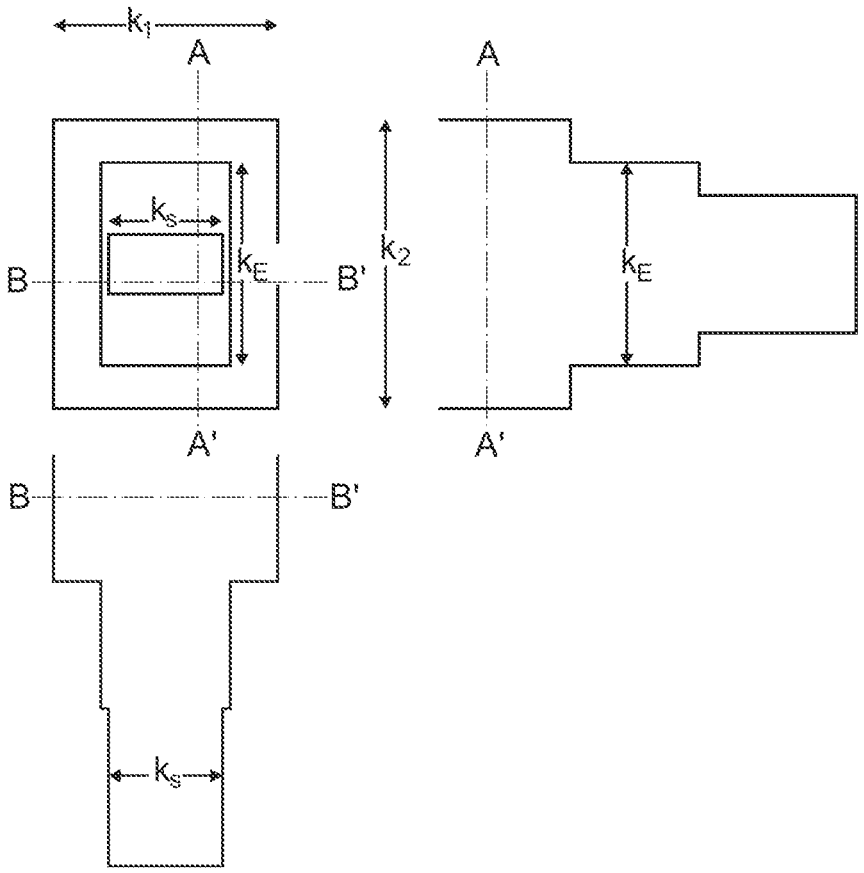

FIG. 7*d* schematically shows an advantageous embodiment of a dielectrically filled horn antenna of stepped design that has a rectangular aperture.

FIG. 7*d* shows the view of the horn from above (plan view) with the aperture edges $k_1$ and $k_2$, and also shows the longitudinal sections through the horn antennas along the lines A-A' and B-B'.

The horn antenna is now designed such that a first rectangular cross section through the horn exists that has an opening having a long edge $k_E$ and a second cross section through the horn exists that has an opening having a long edge $k_s$.

If the reception band of the antenna system is now at lower frequencies than the transmission band and if the edge $k_E$ is now chosen such that the associated lower cutoff frequency of a dielectrically filled waveguide having a long edge $k_E$ is below the lowest useful frequency of the reception band of the antenna system, the horn antenna is able to support the reception band.

If, in addition, the edge $k_s$ is chosen such that the associated lower cutoff frequency of a dielectrically filled waveguide having a long edge $k_S$ is below the lowest useful frequency of the transmission band of the antenna system, the horn antenna is also able to support the transmission band, and this applies even when the reception band and the transmission band are a long way apart.

Since, in FIG. 7*d*, the edge $k_s$ is situated orthogonally with respect to the edge $k_E$, such a horn antenna supports two orthogonal linear polarizations simultaneously, since the corresponding waveguide modes are linearly polarized and orthogonal with respect to one another.

Horn antennas of such stepped design can also be operated without or just with partial dielectric filling as appropriate, and the embodiment shown in FIG. 7*d* can be expanded to any number of rectangular horn cross sections and hence to any number of useful bands.

If the horn antennas of the antenna system are now meant to be dense, i.e. if no parasitic sidelobes (grating lobes) are meant to arise in the antenna pattern of the antenna system, a further advantageous embodiment has the edge lengths $k_1$ and $k_2$ of the rectangular aperture of the horn antennas chosen such that both $k_1$ and $k_2$ are less than or at most equal to the wavelength of the reference frequency, which is in the transmission band of the antenna.

In this case, the available installation space is then utilized in optimum fashion and the maximum antenna gain is obtained.

Figure 8:
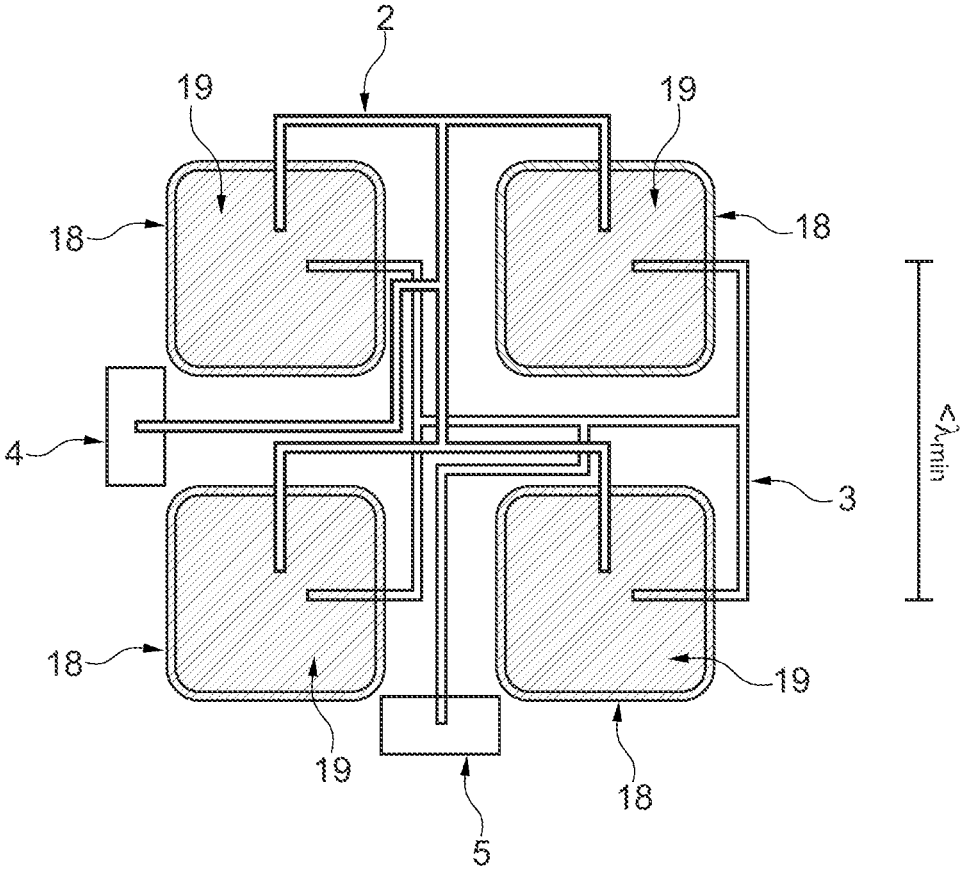
FIG. 8 schematically shows the detailed design of a 2×2 module comprising dielectrically filled horn antennas.

FIG. 8 shows an exemplary 2×2 antenna module that comprises four dielectrically filled horn antennas 18. As FIG. 7*b-c* show, the inputs and outputs into and from the microstrip line networks 2, 3 are in this case embedded completely in the dielectric 19. Otherwise, the module is no different than the corresponding module comprising ridged horn antennas, as shown in FIG. 5, and the microstrip line networks 2, 3 are each connected to the waveguide couplings 4, 5.

Figure 9:
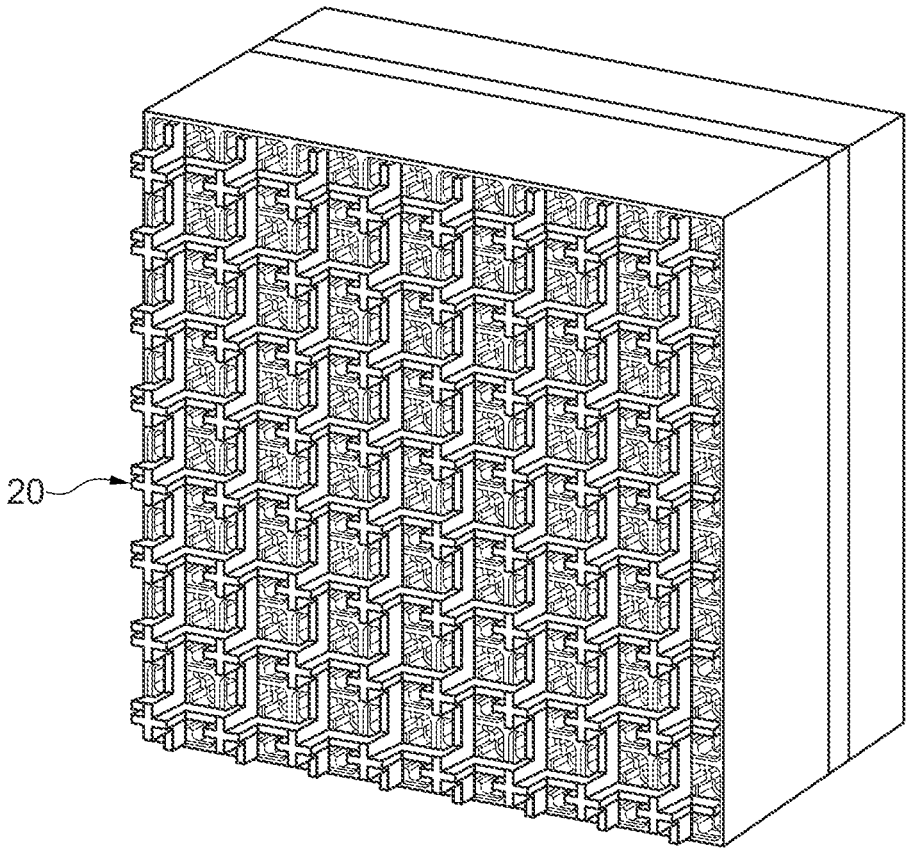
FIG. 9 shows an inventive module that is provided with a dielectric grating in order to improve the impedance matching.

FIG. 9 shows a further advantageous embodiment. In this case, the module is equipped with a dielectric grating 20 that extends over the entire aperture opening. Dielectric gratings 20 of this kind can greatly improve the impedance matching particularly at the lower frequency band of the single radiating elements 1 by reducing the effective wavelength close to the aperture openings of the single radiating elements In the example shown in FIG. 9, this is achieved by virtue of there being dielectric crosses over the centers of the aperture openings of the single radiating elements. However, other embodiments such as cylinders, spherical bodies, parallelepipeds, etc., are also possible. It is also by no means necessary for the dielectric grating 20 to be regular or periodic. By way of example, it is thus conceivable for the grating to have a different geometry for the horn antennas 1 at the edge of the antenna than for the horn antennas 1 in the center. Hence, it would be possible to modulate edge effects, for example.

Figure 10A:
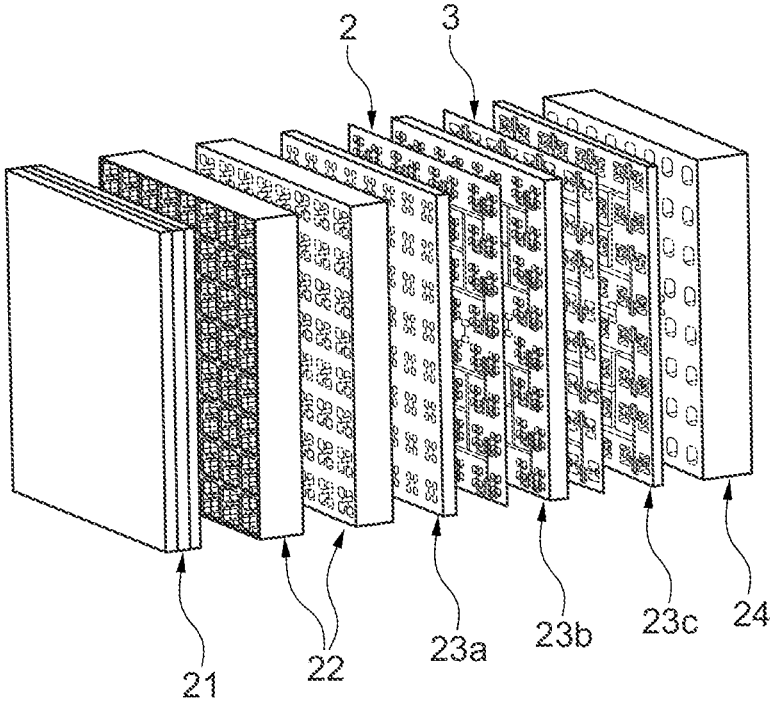
FIG. 10*a-b* show an inventive module using a layer technique.
Figure 10B:
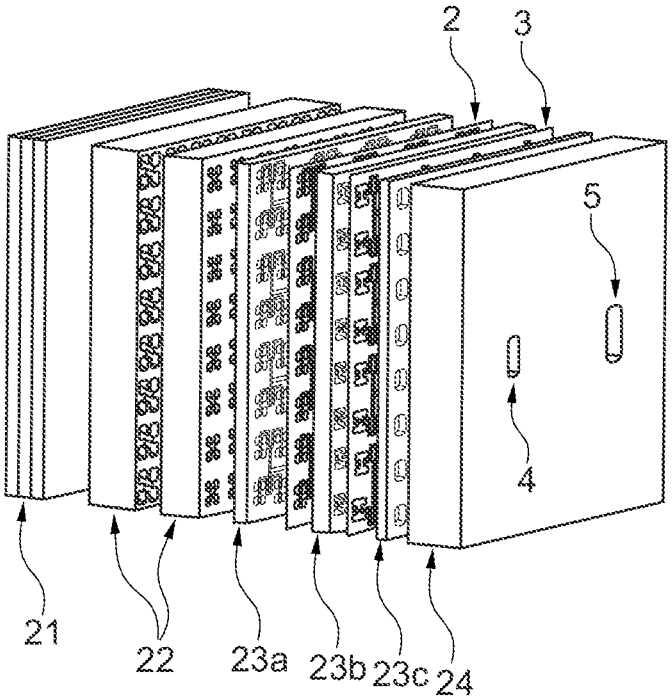

FIG. 10*a-b* show an exemplary module that is designed using a layer technique. This technique allows inventive modules to be produced particularly inexpensively. In addition, the reproducibility of the modules is ensured even at very high frequencies (high tolerance requirements).

The first layer comprises an optional polarizer 21 that is used for circularly polarized signals. The polarizer 21 converts linearly polarized signals into circularly polarized signals, and vice versa, depending on the polarization of the incident signal. Thus, circularly polarized signals that are incident on the antenna system are converted into linearly polarized signals, so that they can be received by the horn antennas of the module without loss. On the other hand, the linearly polarized signals radiated by the horn antennas are converted into circularly polarized signals and are then radiated into free space.

The next two layers form the front portion of the horn antenna array, which comprises the primary horn structures 22 without an input or output coupling unit.

Figure 11A:
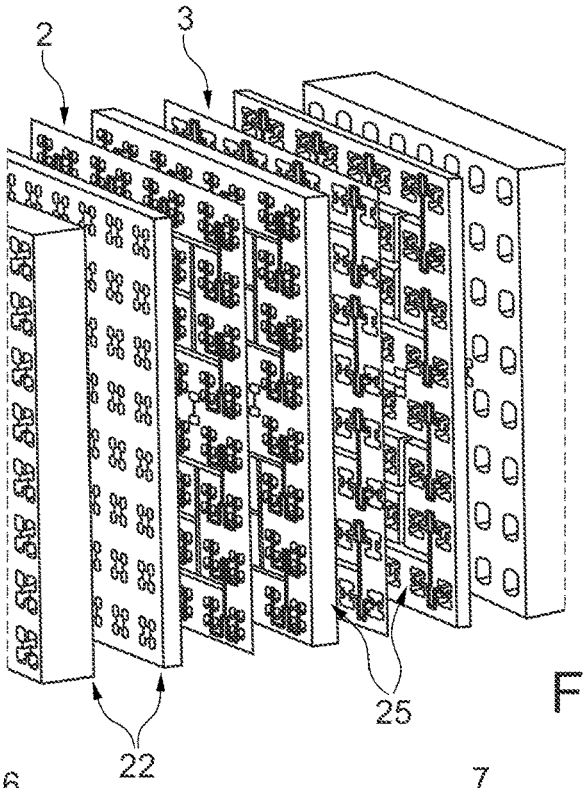
FIG. 11*a-d* show the detailed design of an inventive module using a layer technique.
Figure 11B:
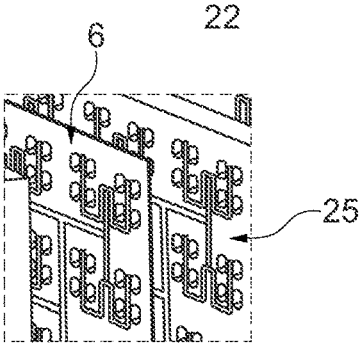
Figure 11C:
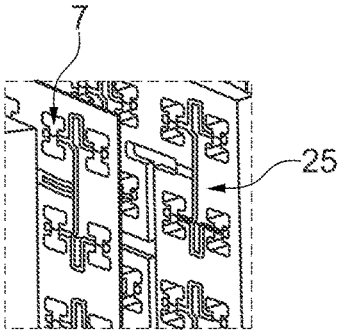
Figure 11D:
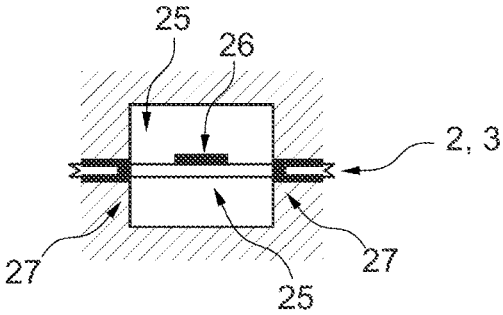

The subsequent layers 23*a*, 2 and 23*b* form the input and output coupling of the first linear polarization into and from the horn antennas of the array. The microstrip line network 2 of the first polarization and the substrate of said network are embedded in metal supports (layers) 23*a*, 23*b*. The supports 23*a*, 23*b* have cutouts (notches) at the points at which a microstrip line runs (cf. also FIG. 11*d*, reference symbol 25).

In the same way, the microstrip line network 3 of the second, orthogonal polarization has its substrate embedded in the supports 23*b*, 23*c*.

The last layer contains the waveguide terminations 24 of the horn antennas and also the waveguide outputs 4 and 5.

The primary horn structures 22, the supports 23*a-c* and waveguide terminations 24 are electrically conductive and can be produced from aluminum, for example, inexpensively using known metalworking methods (e.g. milling, laser cutting, waterjet cutting, electrical discharge machining).

However, it is also conceivable for the layers to be produced from plastic materials that are subsequently entirely or partially coated with an electrically conductive layer (e.g. by electroplating or by chemical means). To produce the plastic layers, it is also possible to use the known injection molding methods, for example. Such embodiments have the advantage over layers comprising aluminum or other metals that a considerable weight reduction can be obtained, which is advantageous particularly for applications of the antenna system on aircraft.

This layer technique therefore provides a highly efficient and inexpensive antenna module even in the case of very high GHz frequencies.

The layer technique described can be used in the same way both for antenna modules comprising ridged horns and for modules comprising dielectrically filled horns.

FIG. 11*a-d* show the detailed design of the microstrip line networks 2, 3 embedded in the metal supports. The cutouts (notches) 25 are designed such that the microstrip lines 26 of the microstrip line networks 2, 3 run into closed metal cavities. The microwave losses are minimized as a result.

Since, for a finite thickness of the substrates (board) of the microstrip lines 26, a gap remains between the metal layers through which microwave power could escape, provision is also made for the substrates to be provided with metal plated-through holes (vias) 27 at the edges of the notches, so that the metal supports have an electrical connection, and the cavities are thus completely electrically closed. If the plated-through holes 27 are sufficiently dense along the microwave lines 26, no further microwave power can escape.

Preferably, the plated-through holes 27 terminate flush with the metal walls of the cavity 25. If, in addition, a thin, low-loss substrate (board material) is used, the electromagnetic properties of such a design are similar to those of an air-filled coaxial line. In particular, a very broadband microwave line is possible and parasitic higher modes are not capable of propagation. In addition, the tolerance requirements are low even at very high GHz frequencies.

With very thin substrates (e.g. <20 μm) and correspondingly low useful frequencies, it is sometimes also possible to dispense with the plated-through holes, since even without plated-through holes it is then practically impossible for microwave power to escape through the then very narrow slots.

The horn antenna inputs and outputs 6, 7 are integrated directly in the metal supports.

Figure 12:
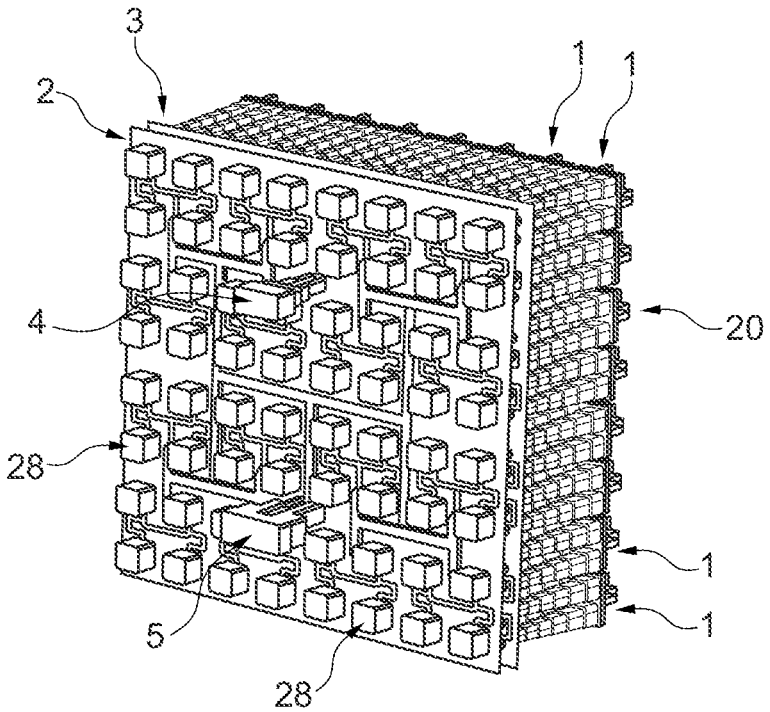
FIG. 12 schematically shows the vacuum model of an inventive module.

FIG. 12 shows the vacuum model of an exemplary 8×8 antenna module. Horn antennas 1 are densely packed and there is nevertheless more than sufficient installation space remaining for the microstrip line networks 2, 3, and also for the waveguide terminations 28 of the single radiating elements 1 and the waveguide couplings 4, 5. A dielectric grating 20 is mounted in front of the aperture plane.

In a further advantageous embodiment, the waveguide networks that couple the modules to one another are constructed from ridged waveguides. This has the advantage that ridged waveguides can have a very much greater frequency bandwidth than conventional waveguides and can be designed specifically for different useful bands.

Figure 13:
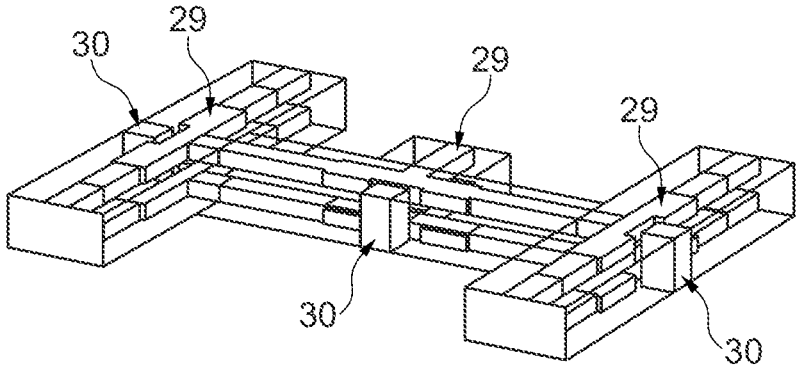
FIG. 13 shows the exemplary design of a waveguide power divider that is compiled from double-ridged waveguides.

An exemplary network comprising double-ridged waveguides is shown schematically in FIG. 13. The rectangular waveguides are provided with symmetrical geometric constrictions 29 that are augmented by perpendicular constrictions 30 at the location of the power dividers.

The ridged waveguides and the corresponding power dividers can be designed using methods of numerical simulation for such components, depending on the requirements for the network.

It is not absolutely necessary to use double-ridged waveguides. Single-ridged or quad-ridged waveguides are also conceivable, for example.

In an embodiment that is not shown, the waveguides of the inter-modular waveguide networks are filled entirely or partially with a dielectric. Such fillings can substantially reduce the installation space requirement in comparison with unfilled waveguides for the same useful frequency. The result is then very compact antennas optimized for installation space, which are particularly suitable for applications on aircraft. In this case, both standard waveguides and waveguides having geometric constrictions can be filled with a dielectric.

Figure 14:
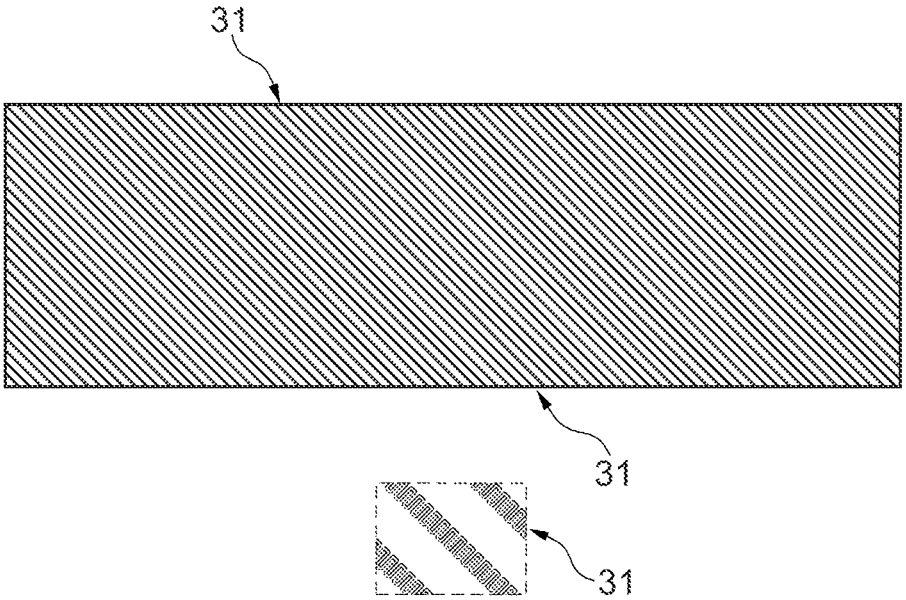
FIG. 14 schematically shows a layer of a polarizer.

In a further advantageous embodiment, the antenna is equipped with a multilayered meander line polarizer. FIG. 14 shows a layer for such a polarizer by way of example.

In order to achieve axis ratios for the circularly polarized signals close to 1 (0 dB), multilayered meander line polarizers are used.

In an embodiment that is not shown, this is achieved by virtue of a plurality of the layers shown in FIG. 14 being arranged above one another in parallel planes. Situated between the layers is a low-loss layer of foam material (e.g. Rohacell, XPS) having a thickness in the region of one quarter of a wavelength. When there are lower requirements for the axis ratio, however, it is also possible to use fewer layers. Equally, it is possible to use more layers if the requirements for the axis ratio are high.

One advantageous arrangement is a 4-layer meander line polarizer that can be used to attain axis ratios below 1 dB, which is usually adequate in practice.

The design of the meander line polarizers is geared to the useful frequency bands of the antenna system and can be effected using methods of numerical simulation for such structures.

In the exemplary embodiment in FIG. 14, the meander lines 31 are situated at an angle of approximately 45° with respect to the main axes of the antenna. The result of this is that incident signals that are linearly polarized along a main axis are converted into circularly polarized signals. Depending on the main axis with respect to which the signals are linearly polarized, a left-circularly polarized or a right-circularly polarized signal is produced.

Since the meander line polarizer is a linear component, the process is reciprocal, i.e. left-circularly and right-circularly polarized signals are converted into linearly polarized signals in the same way.

It is likewise conceivable to use geometric structures other than meander lines for the polarizers. A large number of passive geometric conductor structures are known that can be used to convert linearly polarized signals into circularly polarized signals. The instance of application governs which structures are most suitable for the antenna.

As FIG. 10 shows, the polarizer 21 can be mounted in front of the aperture opening. This provides a relatively simple way of using the antenna both for linearly polarized signals and for circularly polarized signals without the need for the internal structure to be altered for this.

In a further advantageous embodiment, the antenna is equipped with a parabolic amplitude configuration that is realized by virtue of an appropriate design of the power dividers of the feed networks. Since the antenna pattern needs to be below a mask prescribed by the regulations, such amplitude configurations can produce very much higher maximum permitted spectral EIRP densities during transmission operation than without such configurations. Particularly for antennas with a small aperture surface area, this is of great advantage because the maximum regulation-compliant spectral EIRP density is directly proportional to the achievable data rate and hence to the costs of a corresponding service.

Figure 15A:
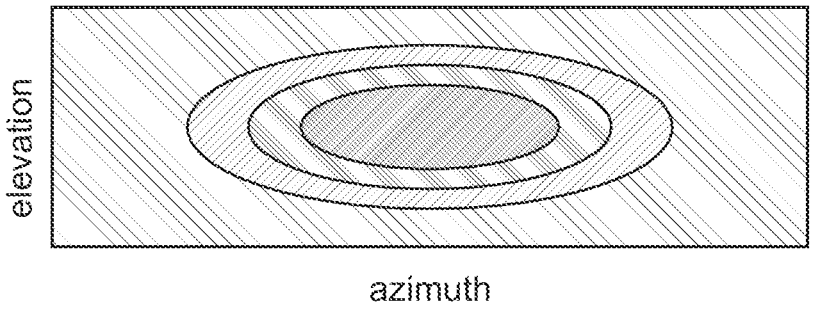
FIG. 15*a-b* show by way of example a schematic amplitude configuration for an inventive antenna system, and the resultant maximum regulation-compliant spectral EIRP density.

FIG. 15*a* schematically shows such an amplitude configuration. The power contributions of the individual horn antennas decrease from the center of the aperture to the edge. This is shown by way of example in FIG. 15*a* by different degrees of blackening (dark: high power contribution, light: low power contribution). In this case, the power contributions decrease in both main axis directions (azimuth and elevation). For all skews, this results in an antenna pattern that is matched to the regulatory mask in approximately optimum fashion.

Depending on the requirements for the antenna pattern, however, it may also be sufficient for the aperture to be configured in one direction only.

It is also conceivable for the amplitude configuration to have a parabolic profile only in the region around the antenna center but to rise again as the edge is approached, as a result of which a closed curve exists around the antenna center and the power contributions of the single radiating elements decrease from the center of the antenna to each point on this curve. Such amplitude configurations may be advantageous particularly for non-rectangular antennas.

Figure 15B:
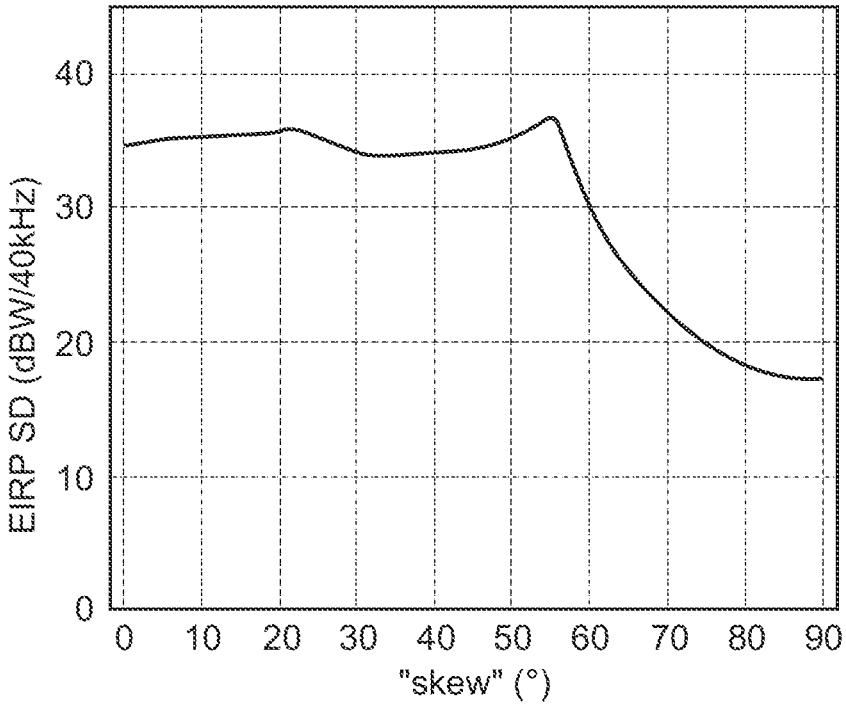

FIG. 15*b* shows, by way of example, the maximum regulation-compliant spectral EIRP density (EIRP SD) that follows from an amplitude configuration—which is parabolic in both main axis directions—for a rectangular 64×20 Ka band antenna, as a function of the skew around the main beam axis. Without parabolic configuration, the EIRP SD would be approximately 8 dB lower in the range from 0° skew to approx. 55° skew and approx. 4 dB lower in the range from approx. 55° skew to approx. 90° skew.

Figure 16:
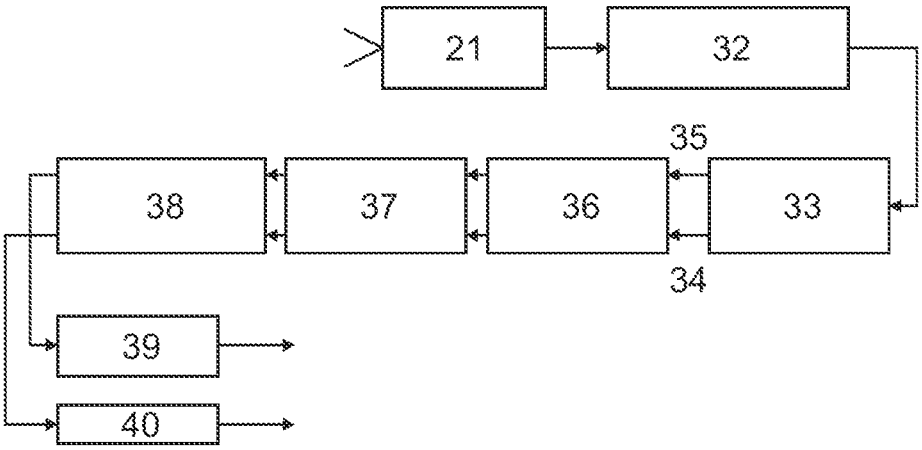
FIG. 16 shows a possible design of an inventive antenna system with fixed polarization for the transmission and received signals in the form of a block diagram.
Figure 17:
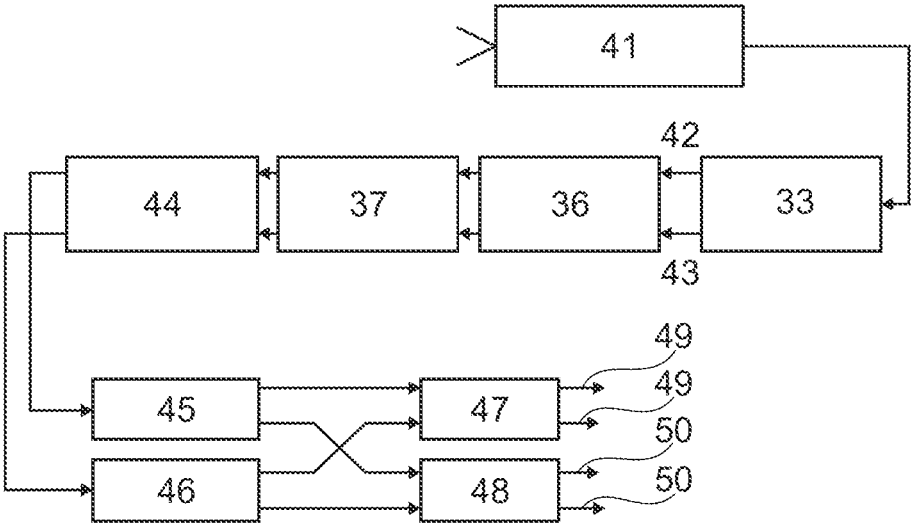
FIG. 17 shows a possible design of an inventive antenna system with variable polarization of the transmission and received signals using 90° hybrid couplers in the form of a block diagram.
Figure 18:
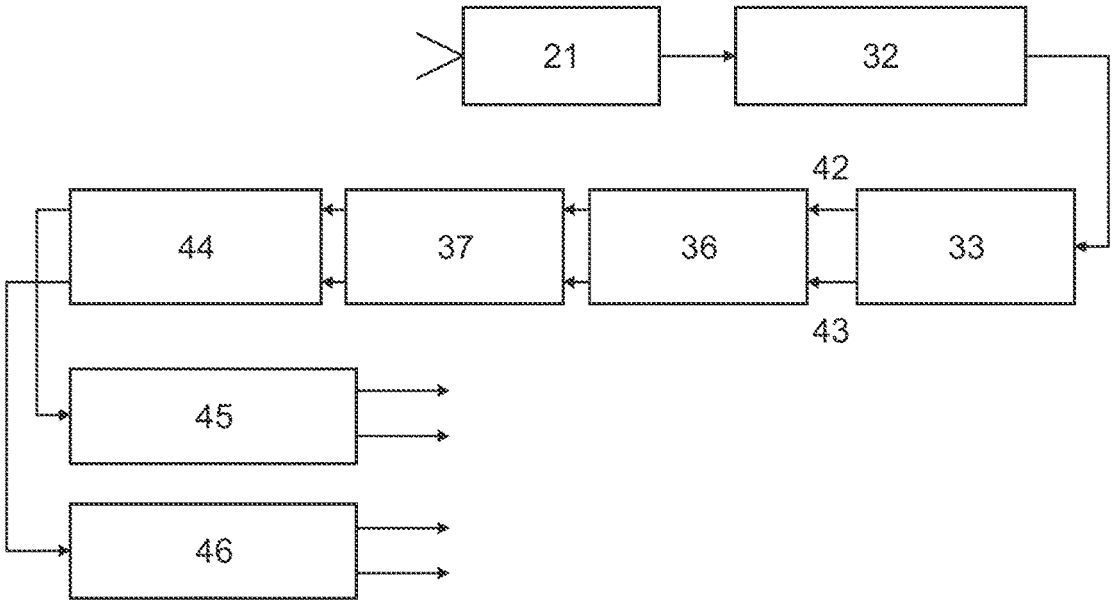
FIG. 18 schematically shows the design of an inventive antenna system with variable polarization for the transmission and received signals using a polarizer in the form of a block diagram.

FIG. 16-18 show the basic design of a series of inventive antenna systems with a different scope of functions in the form of block diagrams.

The antenna system that has its basic design shown in FIG. 16 is suitable particularly for applications in the K/Ka band (reception band approx. 19.2 GHz-20.2 GHz, transmission band approx. 29 GHz-30 GHz) in which the polarizations of the transmission and received signals are firmly prescribed and orthogonal with respect to one another (i.e. the polarization direction of these signals does not change).

Since circularly polarized signals are typically used in the K/Ka band, a polarizer 21 is first of all provided. This is followed by an antenna array 32, which is constructed either from quad-ridged horn antennas or from dielectrically filled horn antennas. The aperture openings of the individual horn antennas typically have dimensions smaller than 1 cm×1 cm in this frequency range.

According to the invention, the antenna array 32 is organized in modules, with each single radiating element having two microstrip line inputs and outputs 33 that are separated according to polarizations and that in turn, separated according to polarizations, are connected to two microstrip line networks 36.

Since the polarization of the transmission and received signals is firmly prescribed and is typically orthogonal with respect to one another, provision is made here for the microstrip line network 36 of one polarization to be designed for the transmission band and for the microstrip line network 36 of the other polarization to be designed for the reception band.

This has the advantage that the microstrip line network 36 of the reception band can be designed for minimum losses, and hence the G/T of the antenna is optimized.

In the exemplary design in FIG. 16, the polarizer 21 is oriented such that the signals in the transmission band 34 are circularly polarized on a right-handed basis and the signals in the reception band 35 are circularly polarized on a left-handed basis.

The signals—separated according to polarization and frequency band—of the two microstrip line networks 36 of the individual modules are now coupled into two waveguide networks 38 by means of microstrip line-to-waveguide couplings 37.

In this case too, provision is made for the two waveguide networks 38 to be optimized for the relevant band that they are meant to support.

By way of example, it is thus possible to use different waveguide cross sections for the reception band waveguide network and the transmission band waveguide network. In particular, it is possible to use enlarged waveguide cross sections, which can sharply reduce the dissipative losses in the waveguide networks and hence substantially increase the efficiency of the antennas.

In addition, a reception band frequency filter 39 is provided in order to protect the low-noise reception amplifier, which is typically mounted directly at the reception band output of the antenna, against overdrive by the strong transmission signals.

In order to achieve the sideband suppression required by the regulations in the transmission band, an optional transmission band filter 40 is additionally provided. This is required when a transmission band power amplifier (HPA), not shown, does not have a sufficient filter at its output, for example.

The design shown in FIG. 16 for the inventive antenna system has a further, very important advantage, particularly for satellite antennas. Since the transmission band feed network and the reception band feed network are separated from one another completely both at the level of the microstrip lines and at the level of the waveguides, it becomes possible to use different amplitude configurations for the two networks.

By way of example, it is thus possible for the reception band feed network to be configured homogeneously, i.e. the power contributions of all the horn antennas of the antenna are the same in the reception band and all the power dividers both at the level of the reception band microstrip line network and at the level of the reception band waveguide network are symmetrical 3 dB power dividers when the feed network is designed as a complete and completely symmetrical binary tree.

Since homogeneous amplitude configurations result in maximum possible antenna gain, the effect achieved by this is that the antenna has maximum power in the reception band and the ratio of antenna gain to background noise G/T for the antenna is maximized.

On the other hand, the transmission band feed network can be provided with a parabolic amplitude configuration independently of the reception band feed network such that the regulation-compliant spectral EIRP density is maximized.

Although such parabolic amplitude configurations reduce the antenna gain, this is noncritical because it remains limited just to the transmission band and does not affect the reception band, subject to design.

The essential performance features of satellite antennas, particularly of satellite antennas of small size, are the G/T and the maximum regulation-complaint spectral EIRP density.

The G/T is directly proportional to the data rate that can be received via the antenna. The maximum regulation-compliant spectral EIRP density is directly proportional to the data rate that can be transmitted using the antenna.

With antenna systems that are designed as shown in FIG. 16, both performance features can be optimized independently of one another.

In the case of very small satellite antennas, this results in yet a further advantage. The reason is that in this case there is the problem that the width of the main beam in the reception band can become so great that not only signals from the target satellite but also signals from adjacent satellites are received. The signals from adjacent satellites then effectively act as an additional noise contribution, which can result in considerable degradation of the effective G/T.

In the case of inventive antenna systems that are designed as shown in FIG. 16, this problem can be solved at least to some extent. This is because if the reception band feed network does not have homogeneous amplitude configuration, for example, but rather has hyperbolic amplitude configuration, the width of the main beam of the antenna decreases. In this case, hyperbolic amplitude configurations are distinguished in that the power contributions of the single radiating elements of the antenna array increase from the center to the edge.

The effect that can be achieved by an amplitude configuration that is hyperbolic at least in a subregion of the antenna system is therefore that the intensity of the interference signals received from adjacent satellites by the antenna decreases and the effective G/T in such an interference scenario increases.

FIG. 17 shows the design of an inventive antenna system in the form of a block diagram that allows simultaneous operation with all four possible polarization combinations for the signals.

The antenna system first of all comprises an antenna array 41 of broadband, dual-polarized horn antennas, that is to say quad-ridged horn antennas, for example, which—according to the invention—are organized in modules.

In contrast to the embodiment that is shown in FIG. 16, in this case no polarizer is used, however, but rather each horn antenna receives and sends two orthogonal linear polarized signals, which, however, contain the complete information even during operation with circularly polarized signals.

The essential difference over the embodiment in FIG. 16 is thus that at the level of the feed networks there is no separation into a reception band feed network and a transmission band feed network, but rather the signals are separated only on the basis of their different polarization.

All the signals 42 with the same polarization are brought together in the first microstrip line network after output coupling 33 from the antenna array, and all the signals with the orthogonal polarization 43 are brought together in the second microstrip line network.

In this case, the two microstrip line networks 36 are designed such that they support both the transmission band and the reception band. Optimization of the feed networks for one of the bands is possible only to a restricted degree in this case. Instead, all four polarization combinations are available simultaneously, however.

While the inventive microstrip line networks 36 are, subject to design (design similar to coaxial lines), typically already so broadband that they can support the reception and transmission bands simultaneously, the waveguide networks 44 must, if very large bandwidths are required, be designed specifically for this after the microstrip-to-waveguide transition 37. This can be accomplished by the ridged waveguides described in FIG. 13, for example. However, it is also possible to use dielectrically filled waveguides, for example.

In order to separate reception band signals and transmission band signals, two frequency diplexers 45, 46 are provided, one for each polarization. In this case, the frequency diplexers 45, 46 are low-attenuation waveguide diplexers, for example.

During operation with linearly polarized signals, all the linear polarization combinations are then available simultaneously at the output of the two diplexers: two respective orthogonally polarized linear signals in the reception band 49 and in the transmission band 50.

During operation with circularly polarized signals, there are additionally two 90° hybrid couplers 47, 48 provided, one for the reception band 49 and one for the transmission band 50, these being able to be used to combine circularly polarized signals from the linear polarized signals that are present at the output of the frequency diplexers 45, 46. In this case, the 90° hybrid couplers 47, 48 are low-attenuation waveguide couplers, for example.

The output of the two 90° hybrid couplers 47, 48 then provides all four possible circularly polarized signals (right-hand and left-hand circular in both the reception band 49 and the transmission band 50) simultaneously.

If appropriate HF switches and/or HF couplers are fitted between diplexers 45, 46 and 90° hybrid couplers 47, 48 and are used to couple out the linearly polarized signals, the antenna system can also be used for simultaneous operation with four different linearly polarized signals and four different circularly polarized signals. Many other combination options and the corresponding antenna configurations are also possible.

FIG. 18 shows the design of an inventive antenna system in the form of a block diagram that has the same scope of functions as the antenna shown in FIG. 16, but is organized differently.

In the design shown in FIG. 18, operation with circularly polarized signals involves the use of a polarizer 21 instead of the 90° hybrid couplers 47, 48 of the design shown in FIG. 17.

The feed networks 36, 44 again process two orthogonal polarizations separately from one another (in this case left-circular and right-circular) and are each of corresponding broadband design for the reception band and the transmission band.

The output of the frequency diplexers 45, 46 then directly provides the four polarization combinations of circularly polarized signals simultaneously; the frequency diplexer 45 for the first circular polarization provides the signal in the reception and transmission bands, and the frequency diplexer 46 for the second (orthogonal with respect to the first) circular polarization provides the signal in the reception and transmission bands.

The use of two 90° hybrid couplers (not shown) that are connected to the diplexers 45, 46 in a manner similar to the design in FIG. 17 also allows the design shown in FIG. 18 to be designed for the operation of linearly polarized signals, or simultaneous operation with circularly and linearly polarized signals is possible with the relevant switching matrix.

The advantage of the design shown in FIG. 18 is that no 90° hybrid couplers are required for operation with circularly polarized signals. This can save installation space or weight, for example, depending on the application. Cost advantages may also arise in some cases.

By contrast, the advantage of the design shown in FIG. 17 is that during operation with circularly polarized signals the axis ratio for the circularly polarized signals can be set without restriction, in principle, by means of the respective power contributions at the input of the 90° hybrid couplers 47, 48.

By way of example, this may be advantageous if the antenna is operated under a radom. It is known that, particularly for high GHz frequencies, the radom material and the radom curvature may mean that radoms have polarization anisotropies that result in the axis ratio for circularly polarized signals being greatly altered upon passage through the radom.

The result of this effect is that the cross polarization isolation can fall sharply, which can severely impair the achievable channel separation and ultimately results in degradation of the achievable data rate.

A design of the antenna as shown in FIG. 17 now allows the axis ratio for the circularly polarized signals to be set, e.g. during transmission operation, such that subsequent polarization distortion brought about by passage through the radom is compensated for. The cross polarization isolation is therefore effectively not degraded.

The invention claimed is:

1. An antenna system for wireless communication of data, the antenna system comprising:

at least four horn antennas coupled to each other, such that the at least four horn antennas communicate the data in parallel;

at least four cavities respectively associated with the horn antennas, each having three layered portions;

a dielectric provided in each respective layered portion associated with each respective cavity, such that the dielectric substantially fills each respective cavity, wherein the dielectric has a dielectric constant between about 1.8 and 3; and two microstrip line networks arranged between two adjacent layered portions associated with each respective cavity and configured to communicate with the horn antennas.

2. The antenna system according to claim 1, wherein each horn cavity is completely filled with dielectric.

3. The antenna system according to claim 1, wherein a dielectric constant of the dielectric is greater than or equal to a ratio of a free-space wavelength of a lowest useful frequency of the antenna system to a free-space wavelength of a reference frequency, the reference frequency being within a transmission band of the antenna system.

4. The antenna system according to claim 1, wherein a dielectric constant of the dielectric is between 1.8 and 3.

5. The antenna system according to claim 4, wherein the dielectric constant of the dielectric is between 1.9 and 2.1.

6. The antenna system according to claim 1, wherein the two microstrip line networks are in a binary tree configuration such that the microstrip line networks may communicate with the horn antennas in parallel.

7. The antenna system according to claim 1, wherein:

the microstrip line networks are formed on a substrate and include microstrip lines routed in cavities of the substrate, and walls of the cavities are electrically conductive.

8. The antenna system according to claim 7, wherein the substrate is provided with metal plated-through holes configured to establish an electrical contact between the walls of the cavities.

9. The antenna system according to claim 1, wherein the microstrip line networks include microstrip lines having dimensions that support both a transmission band and a reception band of the antenna system.

10. The antenna system according to claim 1, wherein the microstrip line networks include:

a first microstrip line network including first microstrip lines having dimensions that support a reception band of the antenna system, and a second microstrip line network including second microstrip lines having dimensions that support a transmission band of the antenna system.

11. The antenna system according to claim 10, wherein:

the first microstrip line network is configured so that in the reception band, power contributions of the horn antennas are approximately equal, and the second microstrip line network is configured so that in the transmission band, power contributions of at least some of the horn antennas are different than one another.

12. The antenna system according to claim 1, further comprising:

90° hybrid couplers coupled to the microstrip line networks, and configured to produce circularly polarized signals from linearly polarized signals, such that the microstrip line networks may communicate circularly polarized signals with the horn antennas.

13. The antenna system according to claim 1, further comprising:

a polarizer coupled to the horn antennas, and configured to communicate circularly polarized signals with the horn antennas.

14. The antenna system according to claim 13, wherein the polarizer includes a multilayered meander line polarizer that is mounted in front of apertures of the horn antennas.

15. The antenna system according to claim 1, wherein each horn antenna has an approximately rectangular aperture, a larger edge of the aperture being shorter than 1.5 cm.

16. The antenna system according to claim 15, wherein the larger edge of the aperture is shorter than 1 cm.

17. The antenna system according to claim 1, wherein the horn antennas are stepped horn antennas.

18. The antenna system according to claim 1, wherein each horn antenna has an approximately rectangular aperture, a length of at least one edge of the aperture being less than or equal to a wavelength of a reference frequency, the reference frequency being within a transmission band of the antenna system.

19. The antenna system according to claim 18, wherein the horn antennas are stepped horn antennas, each horn antenna having:

a first rectangular section, a longer edge of an opening of the first rectangular section being greater than or equal to half a ratio of a free-space wavelength of a lowest cutoff frequency of the antenna system to a square root of a dielectric constant of the dielectric, and a second rectangular section, a longer edge of an opening of the second rectangular section being greater than or equal to half a ratio of a free-space wavelength of a highest useful frequency of the antenna system to the square root of the dielectric constant of the dielectric.

20. The antenna system according to claim 1, wherein each horn antenna is configured to support communications at a first polarization and a second polarization that are orthogonal to one another.

21. The antenna system according to claim 20, wherein the first and second polarizations are linear polarizations.

22. The antenna system according to claim 20, further comprising:

a first microstrip line network configured to communicate with the horn antennas at the first polarization; and a second microstrip line network separated from the first microstrip line network and configured to communicate with the horn antennas at the second polarization.

23. The antenna system according to claim 1, wherein an interval between phase centers of at least two adjacent horn antennas is less than or equal to a wavelength of a reference frequency that lies within a transmission band of the antenna system.

24. The antenna system according to claim 1, wherein at least one of the horn antennas is equipped with at least one of a dielectric cross septum or a dielectric lens.

25. The antenna system according to claim 1, further comprising:

frequency diplexers configured to separate signals of a transmission band and signals of a reception band, and communicate the separated signals with the horn antennas.

26. An antenna array for wireless communication of data, the antenna array comprising:

a plurality of antenna systems according to claim 1; and waveguide networks coupling the antenna systems one to another, the waveguide networks configured to communicate data with the antenna systems.

27. The antenna array according to claim 26, wherein the waveguide networks include:

a first waveguide network configured to couple signals of a first polarization into or out of the antenna systems, and a second waveguide network configured to couple signals of a second polarization into or out of the antenna systems.

28. The antenna array according to claim 27, wherein:

the first waveguide network includes waveguides having dimensions that support a reception band of the antenna array, and the second waveguide network includes waveguides having dimensions that support a transmission band of the antenna array.

29. The antenna array according to claim 28, wherein:

the first waveguide network is configured so that in the reception, power contributions of the horn antennas are approximately equal, and the second waveguide network is configured so that in the transmission band, power contributions of at least some of the horn antennas are different than one another.

30. The antenna array according to claim 29, wherein the second waveguide network is configured so that in the transmission band, the power contributions of the horn antennas that are located at an edge of the antenna array are smaller than the power contributions of the horn antennas that are located in a center of the antenna array.

31. The antenna array according to claim 27, wherein at least one of the waveguide networks has at least one geometric constriction along a propagation direction of an electromagnetic wave in the at least one of the waveguide networks.

32. The antenna array according to claim 27, wherein at least one of the waveguide networks includes a single-ridged or double-ridged waveguide.

33. The antenna array according to claim 27, wherein at least one of the waveguide networks is filled with dielectric.

34. The antenna array according to claim 27, wherein the waveguide networks include waveguides having dimensions that support both a transmission band and a reception band of the antenna array.

35. The antenna array according to claim 27, wherein the waveguide networks are in a binary tree configuration, such that the waveguide networks may communicate with the antenna systems in parallel.

36. The antenna system according to claim 1, wherein each horn antenna includes input and output coupling points embedded in the corresponding dielectric and coupled to the microstrip line networks.

* * * * *